US012768579B2

(12) United States Patent
Fösel

(10) Patent No.: US 12,768,579 B2
(45) Date of Patent: Oct. 20, 2026

(54) REFRIGERATION SYSTEM AND METHOD OF DETERMINING A STATE OF CHARGE OF REFRIGERANT THEREIN

(71) Applicant: Maersk Container Industry A/S, Tinglev (DK)

(72) Inventor: Georg Patrick Franz Fösel, Tinglev (DK)

(73) Assignee: Maersk Container Industry A/S, Tinglev (DK)

( * ) Notice: Subject to any disclaimer, the term of this patent is extended or adjusted under 35 U.S.C. 154(b) by 164 days.

(21) Appl. No.: 18/657,311

(22) Filed: May 7, 2024

(65) Prior Publication Data

US 2024/0288212 A1 Aug. 29, 2024

Related U.S. Application Data

(63) Continuation of application No. PCT/EP2022/082040, filed on Nov. 15, 2022.

(30) Foreign Application Priority Data

Nov. 15, 2021 (DK) ..... PA202101075
May 16, 2022 (DK) ..... PA202200461

(51) Int. Cl.
*F25B 49/02* (2006.01)

(52) U.S. Cl.
CPC ..... *F25B 49/02* (2013.01); *F25B 2400/19* (2013.01); *F25B 2500/222* (2013.01);
(Continued)

(58) Field of Classification Search
CPC ..... F25B 2400/19; F25B 2500/222; F25B 2600/05; F25B 2700/04
See application file for complete search history.

(56) References Cited

U.S. PATENT DOCUMENTS 6,098,412 A * 8/2000 Porter ..... F25B 49/005 62/126
11,131,471 B1 9/2021 Butler et al.
(Continued)

FOREIGN PATENT DOCUMENTS

EP 2257749 A2 12/2010
EP 3201539 A1 8/2017
(Continued)

OTHER PUBLICATIONS

Danish Technical Examination report and Search report dated Feb. 25, 2022 for Danish Application No. PA202100953.
(Continued)

*Primary Examiner* — Jerry-Daryl Fletcher
*Assistant Examiner* — Daniel C Comings
(74) *Attorney, Agent, or Firm* — Fish & Richardson P.C.

(57) ABSTRACT

Provided is a method of determining a state of charge of refrigerant in a refrigeration system, the refrigeration system having a compressor, an expansion valve, a condenser side for passing refrigerant from the compressor to the expansion valve, and an evaporator side for passing refrigerant from the expansion valve to the compressor. The method comprises determining at least one performance characteristic of the refrigeration system when refrigerant is prevented from flowing into the evaporator side from the condenser side, and, when one or more predetermined criteria are met on the basis of the performance characteristic, determining a state of charge in the refrigeration system.

20 Claims, 4 Drawing Sheets

(52) U.S. Cl.
CPC ..... *F25B 2600/111* (2013.01); *F25B 2700/04* (2013.01); *F25B 2700/195* (2013.01); *F25B 2700/197* (2013.01)

(56) References Cited

U.S. PATENT DOCUMENTS

| | | | | |
|---|---|---|---|---|
| 2006/0021362 | A1 | 2/2006 | Sadegh et al. | |
| 2006/0144059 | A1 | 7/2006 | Kang et al. | |
| 2007/0068181 | A1* | 3/2007 | Kim | F25B 49/022 62/228.1 |
| 2010/0088046 | A1 | 4/2010 | Schuster et al. | |
| 2013/0086932 | A1 | 4/2013 | Ishizeki et al. | |
| 2013/0160470 | A1 | 6/2013 | Schuster et al. | |
| 2013/0298995 | A1 | 11/2013 | Mcmasters et al. | |
| 2015/0219376 | A1* | 8/2015 | Douglas | F25B 49/02 62/126 |
| 2015/0377532 | A1 | 12/2015 | Uselton | |
| 2019/0170415 | A1 | 6/2019 | Walser et al. | |
| 2019/0362036 | A1 | 11/2019 | Zhang et al. | |
| 2020/0309434 | A1* | 10/2020 | Walser | F25B 49/005 |
| 2023/0109334 | A1* | 4/2023 | Welch | F25B 49/005 62/129 |

FOREIGN PATENT DOCUMENTS

| | | | | |
|---|---|---|---|---|
| EP | 3252402 | A1 | | 12/2017 |
| EP | 3279589 | A1 | | 2/2018 |
| JP | 2002022304 | A | * | 1/2002 |
| WO | 2016050415 | A1 | | 4/2016 |
| WO | 2017087628 | A1 | | 5/2017 |
| WO | 2020141279 | A1 | | 7/2020 |
| WO | 2021050704 | A1 | | 3/2021 |
| WO | 2021219474 | A1 | | 11/2021 |

OTHER PUBLICATIONS

International Search Report and Written Opinion dated Jan. 30, 2023 for PCT Application No. PCT/EP2022/077607.
Danish Technical Examination report and Search report dated Mar. 8, 2022 for Danish Application No. PA202101075.
Danish Technical Examination report and Search report dated Oct. 25, 2022 for Danish Application No. PA202101075.
International Search Report and Written Opinion dated Feb. 17, 2023 for PCT Application No. PCT/EP2022/082040.
ISO 20854:2019, "Thermal containers—safety standard for refrigerating systems using flammable refrigerants—requirements for design and operation", Oct. 2019.
ISO 12100:2010, "Safety of machinery—general principles for design—risk assessment and risk reduction" Nov. 2010.

* cited by examiner

REFRIGERATION SYSTEM AND METHOD OF DETERMINING A STATE OF CHARGE OF REFRIGERANT THEREIN

CROSS-REFERENCE TO RELATED APPLICATIONS

This application is a continuation under 35 U.S.C. § 120 of International Application No. PCT/EP2022/082040, filed Nov. 15, 2022 which claims priority to Denmark Application No. PA202101075, filed Nov. 15, 2021, and which also claims priority to Denmark Application No. PA202200461, filed May 16, 2022 under 35 U.S.C. § 119 (a). Each of the above-referenced patent applications is incorporated by reference in its entirety.

TECHNICAL FIELD

The present invention relates to methods of determining a state of charge of refrigerant in a refrigeration system, and to controllers, refrigeration systems, storage units and marine vessels.

BACKGROUND

Many types of cargo may be stored in transportable storage units, also referred to as transport units, for transporting cargo on container vessels. Such a storage unit may comprise an atmosphere control system for controlling an atmosphere in the storage unit. This may be used to facilitate the storage and transportation of perishable goods, such as fruit, vegetables, or fresh or frozen meat or fish, or other goods, such as medicaments, in the transport unit. Transport units include reefer containers, which may be TEU or 2-TEU containers designed to be shipped on container vessels, and/or refrigerated trucks or trailers.

Refrigeration systems of storage units are designed to be operated using a predefined level of charge of refrigerant. Inventions as described herein solve problems with determining a loss of charge of refrigerant in refrigeration systems.

SUMMARY

According to a first aspect of the present invention, there is provided a method of determining a state of charge of refrigerant in a refrigeration system, the refrigeration system comprising a compressor, an expansion valve, a condenser side for passing refrigerant from the compressor to the expansion valve, and an evaporator side for passing refrigerant from the expansion valve to the compressor. The method comprises determining at least one performance characteristic of the refrigeration system when refrigerant is prevented from flowing into the evaporator side from the condenser side, and, when one or more predetermined criteria are met on the basis of the performance characteristic, determining a state of charge of refrigerant in the refrigeration system.

The determining the state of charge may comprise determining that the refrigeration system is charged at a nominal level of charge. The nominal level of charge may correspond to an amount of refrigerant that the refrigeration system is designed, or configured, to comprise, in use. In other words, the nominal level of charge may be a rated level of charge of the refrigeration system. The nominal level of charge may comprise a nominal level of charge range. For example, the nominal level of charge range may be "X" kg, plus or minus up to 1%, up to 2%, up to 5%, up to 10%, up to 20%, or greater than 20% of X. In some examples, X may be up to 3 kg, up to 4 kg, up to 5 kg, such as 4.5 kg, up to 6 kg, or greater than 6 kg.

Optionally, the nominal level of charge is a predetermined level of charge, such as a pre-set nominal level of charge for the refrigeration system. The pre-set nominal level of charge may be a level of charge at which the refrigeration system is deemed to operate most efficiently, and/or at which the refrigeration system can provide a desired heat transfer capacity. Optionally, the method comprises determining the nominal level of charge. Optionally, the method comprises receiving information representative of the nominal level of charge. Optionally, the method comprises determining the nominal level of charge on the basis of the information received. The nominal level of charge may be input by a user. For instance, the information may be received from a user input terminal of the refrigeration system, such as after the refrigeration system has been charged with refrigerant. The nominal level of charge may be a level of charge of refrigerant in the refrigeration system at an earlier time, such as at a time of a previous determination of the state of charge.

Optionally, the nominal level of charge is determined, and/or controlled, based on an operating condition of the refrigeration system. Optionally, the nominal level of charge is maintained and/or adjusted based on an operating condition of the refrigeration system. The operating condition may comprise an ambient temperature of an ambient atmosphere surrounding the refrigeration system, a temperature in a space that is refrigerated by the refrigeration system, a heat transfer capacity of the refrigeration system, and/or a heat transfer demand of the refrigeration system, for example. For instance, an increase in the ambient temperature, an increase in the temperature in the space, and/or an increased heat transfer demand, may lead to an increase in the nominal level of charge. This may be due to an increase in temperature in the condenser-side and/or evaporator side leading to an increase in pressure of refrigerant in the condenser-side and/or evaporator side. This may, in turn, increase a density of the refrigerant, meaning more refrigerant is required to provide a set volume of liquid in a heat exchanger, such as a condenser, in the condenser-side, for example. Contrarily, a decrease in the ambient temperature, a decrease in the temperature in the space, and/or a decrease in the heat transfer demand, may lead to a decrease in the nominal level of charge. The nominal level of charge may be a level of charge at which the refrigeration system is able to provide the desired heat transfer demand, optionally in view of the ambient temperature and/or the temperature in the space, most efficiently. For instance, an increase in the heat transfer demand may lead to more refrigerant being required in the refrigeration system for the most efficient operation, and thus an increase in the nominal level of charge. Alternatively, the nominal level of charge may not be affected by changing operating conditions of the refrigeration system.

The determining the state of charge may comprise determining a deviation in the level of charge, such as a deviation in the level of charge from the nominal level of charge. The determining the deviation in the level of charge may comprise determining that a level of charge in the refrigeration system is above or below the nominal level of charge, and/or outside of the nominal level of charge range. For example, the determining the state of charge may comprise determining an overcharge and/or an undercharge of refrigerant, such as relative to the nominal state of charge.

Optionally, the method is a method of determining an overcharge of refrigerant in the refrigeration system. Optionally, the determining the state of charge comprises, when the one or more predetermined criteria are met on the basis of the performance characteristic, determining an overcharge of refrigerant in the refrigeration system. The determining the overcharge of refrigerant may comprise determining that the level of charge of refrigerant in the refrigeration system is higher than the nominal level of charge. This may be, for instance, due to the refrigeration system being charged with a higher level of refrigerant than is required for the envisioned operating conditions of the refrigeration system. Alternatively, or in addition, this may be due to a change in the nominal level of charge, such as a decrease in the nominal level of charge. As described above, changing operating conditions of the refrigeration system may cause a reduction in the nominal level of charge.

Optionally, the method is a method of determining an undercharge of refrigerant in the refrigeration system. Optionally, the determining the state of charge comprises, when the one or more predetermined criteria are met on the basis of the performance characteristic, determining an undercharge of refrigerant in the refrigeration system. The determining the undercharge of refrigerant may comprise determining that the level of charge of refrigerant in the refrigeration system is lower than the nominal level of charge. This may be, for instance, due to the refrigeration system being charged with a lower level of refrigerant than is required for the envisioned operating conditions of the refrigeration system. Alternatively, or in addition, this may be due to a change in the nominal level of charge, such as an increase in the nominal level of charge. As described above, changing operating conditions of the refrigeration system may cause an increase in the nominal level of charge. Alternatively, or in addition, an undercharge of refrigerant may be determined in the event of a loss of charge of refrigerant, such as due to a leak of refrigerant from the refrigeration system.

Optionally, the determining the state of charge comprises, when the one or more predetermined criteria are met on the basis of the performance characteristic, determining a change in the level of charge in the refrigeration system. Optionally, the change in the level of charge is a loss of charge. This may be a reduction in the level of charge from the nominal level of charge, and/or a reduction in a level of charge since an earlier determination of the state of charge. Optionally, the method is a method of determining a change in a level of charge of refrigerant in the refrigeration system, such as a method of determining a loss of charge of refrigerant in the refrigeration system. This may provide an improved way to detect a loss of charge of refrigerant, such as without requiring an external gas sensor for detecting a presence of refrigerant outside the refrigeration system. This may reduce a complexity or cost of the refrigeration system, and/or improve an ease of maintenance of the refrigeration system, while providing a more direct way to determine whether any refrigerant has been lost from the refrigeration system. The method may also provide a quicker and/or more accurate determination of a loss of charge compared to other methods, such as using an external gas sensor.

The loss of charge of refrigerant may be due to, for example, a natural leakage of refrigerant, and/or a loss of integrity of a component of the refrigeration system. The method may comprise causing performance of a remedial action, such as in response to a determination of a loss of charge. The causing performance of the remedial action may comprise issuing an audible and/or visual alert, and/or automatically reconfiguring the refrigeration system, such as to prevent a further loss of charge. Optionally, the causing performance of the remedial action comprises causing a cause of the loss of charge to be remedied, such as by maintenance personnel.

Optionally, the change in the level of charge is a gain of charge. This may be an increase in the level of charge from the nominal level of charge and/or an increase in a level of charge since an earlier determination of the state of charge. Optionally, the method is a method of determining an increase in a level of charge of refrigerant in the refrigeration system. This may advantageously permit, for instance, a determination that the refrigerant in refrigeration system has been topped up following a loss of charge. This may similarly allow a determination that the system has otherwise been charged with refrigerant, such as during a maintenance procedure of the refrigeration system.

Optionally, the method comprises causing the refrigerant to be prevented from flowing into the evaporator side from the condenser side. Optionally, the refrigerant is prevented from flowing into the evaporator side by the expansion valve being closed. Optionally, the method comprises causing the expansion valve to close.

Optionally, the refrigeration system comprises an isolation valve upstream of the expansion valve, the isolation valve being operable to prevent the refrigerant from flowing from the condenser side to the expansion valve and into the evaporator side. Optionally, the method comprises causing operation of the isolation valve to prevent the refrigerant from flowing into the evaporator side from the condenser side.

Optionally, the one or more predetermined criteria being met comprises the at least one performance characteristic meeting, exceeding, or being below a predetermined threshold performance characteristic. The state of charge, such as an overcharge or undercharge, or the change in the level of charge, such as a gain or a loss of charge, may be determined more reliably by comparing the at least one performance characteristic to the predetermined threshold performance characteristic.

Optionally, the at least one performance characteristic comprises a first performance characteristic determined at a first time, and a second performance characteristic determined at a second time, later than the first time. Optionally, the one or more predetermined criteria being met comprises a difference between the first performance characteristic and the second performance characteristic meeting, being below, or exceeding a predetermined threshold. The state of charge, such as an overcharge or undercharge, or the change in the level of charge, such as a gain or a loss of charge, may be determined more reliably by comparing the first and second performance characteristics with one another, such as by taking a mathematical difference between, or by determining a ratio of, the first and second performance characteristics.

Optionally, the refrigeration system is a refrigeration system for a storage unit. Optionally, the storage unit comprises space for storing cargo. Optionally, the storage unit is a reefer container, or refrigerated truck or trailer, such as for transporting the cargo. Optionally, the refrigeration system is part of an atmosphere control system for controlling an atmosphere in the space. Optionally, the refrigeration system and/or the atmosphere control system is configured to cool the space to cool the cargo stored in the space. Optionally, the cargo comprises fresh or frozen produce, which may include respirating and/or ripenable produce such as fruit and vegetables, and/or non-respirating fresh produce, meat and/or fish. The cargo may comprise medicaments, such as vaccines. It will be appreciated that the cargo may be any suitable cargo that may require, or benefit from, being stored in an atmosphere-controlled space.

A quicker and/or more accurate determination of a state (e.g., loss) of charge in the refrigeration system, such as provided by the present method, may be particularly advantageous when applied to refrigeration systems for such storage units. In particular it may allow remedial action to be taken to alleviate any risks associated with refrigerant being present in or around the storage unit, such as in the space, especially where the refrigerant is flammable.

Optionally, the, or each, performance characteristic comprises a pressure in the refrigeration system, such as the condenser-side pressure and/or the evaporator-side pressure. That is, optionally, the, or each, performance characteristic comprises a pressure in the condenser side and/or a pressure in the evaporator side. Optionally, the, or each, performance characteristic comprises a pressure differential between the condenser side and the evaporator side. Optionally, the, or each, pressure differential is a pressure differential across the compressor. Optionally, the, or each, pressure differential comprises a difference between a condenser-side pressure downstream of the compressor, in the condenser side, and an evaporator-side pressure upstream of the compressor, in the evaporator side. Alternatively, the, or each, pressure differential is a ratio between the condenser-side pressure and the evaporator-side pressure.

Optionally, the method comprises determining the condenser-side pressure using, or using an output from, a condenser-side pressure sensor located in the condenser side of the refrigeration system, and determining the evaporator-side pressure using, or using an output from, an evaporator-side pressure sensor located in the evaporator side of the refrigeration system. Optionally, the method comprises determining the pressure differential based on the condenser-side pressure and the evaporator-side pressure.

Pressures in the refrigeration system may be more stable and/or reliable than, for example, temperatures in the refrigeration system, which may lead to a more accurate determination of a state (e.g., loss) of charge when using pressures in the refrigeration system. Moreover, the at least one performance characteristic, such as the, or each, pressure differential, may be determined using sensors which are already installed in the refrigeration system, thereby making further use of performance characteristics that are already measured in the refrigeration system. This may advantageously allow the method to be performed on a refrigeration system without requiring the installation of additional components, such as additional sensors for sensing the performance characteristics, or external components such as gas sensors for detecting the presence of refrigerant outside the refrigeration system, such as in the space of the storage unit described above.

Optionally, the one or more predetermined criteria being met comprises the, or each, pressure differential meeting, or being below or above, a predetermined threshold. Optionally, the predetermined threshold represents a boundary, such as an upper or lower boundary, of the pressure differential when the refrigerant is charged at the nominal level of charge. Optionally, where the method comprises receiving information representative of the nominal level of charge, the information may comprise the predetermined threshold, and/or a pressure differential associated with the nominal level of charge. In this way, the state of charge can be determined without also determining, or knowing, the nominal level of charge. That is, by comparing the pressure differential to the predetermined threshold, an overcharge and/or undercharge, and/or a change in the level of charge, can be determined without knowledge of the nominal level of charge itself.

Optionally, the method comprises causing performance of a pump down event, the pump down event comprising a transfer stage in which refrigerant is prevented from flowing into the evaporator side from the condenser side, and refrigerant in the evaporator side is moved from the evaporator side to the condenser side, so that the refrigeration system reaches a pumped-down state. Optionally, the at least one performance characteristic is determined during the pump down event or during the pumped-down state.

The pump down event may be performed to move, or transfer, some, most, or all of the refrigerant from the evaporator side to the condenser side. Optionally, the transfer stage comprises operating the compressor to move refrigerant from the evaporator side to the condenser side. The compressor may be operated until a desired amount of refrigerant has been moved from the evaporator side to the condenser side. The amount may be a magnitude (such as a volume or mass) of the refrigerant so moved, or may be a percentage of refrigerant present in the evaporator side at a start of the pump down event.

Optionally, the at least one performance characteristic is determined during the transfer stage, such as when the compressor is operating, and/or during the pumped-down state, such as when the compressor is not operating.

Optionally, the pump down event comprises, following the transfer stage, a maintenance stage in which refrigerant is prevented from flowing from the condenser side to the evaporator side, and in which refrigerant is prevented from flowing from the evaporator side to the condenser side. Optionally, the performance characteristic comprises a decay time, the decay time being a time for a pressure differential between the condenser side and the evaporator side to reduce from an elevated pressure differential to a reduced pressure differential, lower than the elevated pressure differential, during the maintenance stage. Optionally, the decay time may be a time for a pressure in the condenser side to reduce from an elevated pressure to a reduced pressure. Optionally, the one or more predetermined criteria being met comprises the decay time meeting, or being below, a decay time threshold.

The maintenance stage may be performed to maintain the pumped-down state of the refrigeration system. The method may comprise switching from the transfer stage to the maintenance stage, such as by causing the compressor to stop operating, once a predetermined pumped-down state is achieved. The predetermined pumped-down state may be achieved when an evaporator-side pressure in the evaporator side meets, or is below, a predetermined evaporator-side pressure threshold. The predetermined evaporator-side pressure threshold may be a saturation pressure of the refrigerant at a temperature of up to −50 C, up to −45 C, up to −40 C, up to −30 C, or greater than −30 C. In this way, no, or only a residual amount of, may remain in the evaporator side following the pump down event. This may reduce a likelihood of liquid refrigerant being present in the evaporator side and entering the compressor during a subsequent operation of the compressor, thereby increasing a longevity of the compressor. Optionally, the evaporator-side pressure threshold is set such that the compressor is prevented from operating before the evaporator-side pressure reaches an operational limit of the compressor, the operational limit being level at which volumetric losses in the compressor prevent the compressor from reducing the evaporator-side pressure further. This may further improve a longevity of the compressor.

Optionally, the at least one performance characteristic is determined when the compressor is operating, such as during the transfer stage, and/or is determined when the compressor is not operating, such as during the maintenance stage.

The maintenance stage may be maintained for a predetermined period of time. Optionally, the refrigeration system comprises a condenser in the condenser side. The predetermined period of time may be a period until a temperature of refrigerant in the condenser side is equal to, or within a predetermined range of, a temperature of an external condenser fluid surrounding, and/or passed through, the condenser, in use. The external condenser fluid may be an ambient atmosphere surrounding the condenser, external to the refrigeration system. In this way, the predetermined period of time may be a time for heat added by the compressor to be dissipated into the external condenser fluid.

The refrigeration system may comprise a condenser gas moving device configured to move the external condenser fluid past, across, or through the condenser. The method may comprise causing operation of the condenser gas moving device during the pump down event. The condenser gas moving device may be operated at up to 50%, up to 80%, or up to 100% of a maximum operating speed of the condenser gas moving device during the pump down event, such as during the maintenance stage. This may be particularly advantageous where the external condenser fluid is an ambient atmosphere, whereby operating the condenser gas moving device may improve an accuracy of the determination of the state (e.g., loss) of charge, such as by reducing an effect of a wind speed on the cooling of refrigerant in the condenser side during the maintenance stage.

The pressure, and/or pressure differential, may be, and may be determined, as described above.

The elevated pressure, or elevated pressure differential, may be a peak pressure, or peak pressure differential, during the pump down event, such as may be achieved towards the end of, or shortly after, the transfer stage, such as during the maintenance stage. Optionally, the elevated pressure, or elevated pressure differential, may be a predetermined elevated pressure, or predetermined elevated pressure differential. The reduced pressure, or reduced pressure differential, may be a pressure, or pressure differential, determined during the maintenance stage. The reduced pressure, or pressure differential, may be a predetermined reduced pressure, or predetermined reduced pressure differential.

In other words, the, or each, pressure, or pressure differential, may increase over time during the transfer stage, as an increasing amount of refrigerant is moved to the condenser side, such as during operation of the compressor. The refrigerant being moved may also be heated by the compressor, further increasing a pressure of the refrigerant. The, or each, pressure, or pressure differential, may then reduce over time during the maintenance stage, such as when the compressor is not operating. This may be due to a transfer of heat from the refrigerant in the condenser side to, for example, an ambient atmosphere surrounding the condenser (where provided), which may cause the pressure to drop.

Optionally, the decay time threshold is predetermined. Optionally, the decay time threshold represents a minimum or maximum decay time that would be expected when the refrigeration system is charged to a predetermined level or the nominal level of charge, which as described above may correspond, or may be a permissible deviation from, a rating of the refrigeration system. In this way, the determining a state (e.g., loss) of charge may be to ensure the refrigeration system is operating as expected.

Optionally, the decay time is determined based on a previous decay time of a previous pump down event of the refrigeration system. The decay time may be less than the previous decay time in the event of an undercharge, or a loss of charge, in the refrigeration system between the pump down event and the previous pump down event. For example, an undercharge or loss of charge in the refrigeration system may lead to less heating of the refrigerant by the compressor during the transfer phase, and/or to less refrigerant being present in the condenser side during the maintenance phase. This may, in turn, lead to a quicker dissipation of heat from the refrigerant, and a quicker reduction in the, or each, pressure differential. That is, a faster reduction in the, or each, pressure differential during the pump down event, such as during the maintenance phase, may be indicative of an undercharge or loss of charge since the previous pump down event. Alternatively, the decay time may be higher than the previous decay time in the event of an overcharge, or increase in charge, in the refrigeration system between the pump down event and the previous pump down event. In this way, comparing the decay time to a previous decay time, and/or to a predetermined decay time, may provide a reliable and convenient way to determine a state (e.g., loss) of charge in the refrigeration system. For instance, if there is no change, little change, and/or a permissible change in the decay time between pump down events, then the method may comprise determining that there has been no change in the level of charge between the pump down events, and/or that the refrigeration system is charged at the nominal level of charge.

Optionally, the pump down event is a first pump down event, and the method comprises causing performance of a second pump down event, after the first pump down event, wherein the at least one performance characteristic comprises: a first performance characteristic determined during the first pump down event; and a second performance characteristic determined during the second pump down event. Optionally, the transfer stage of the first pump down event is a first transfer stage in which the compressor is operated at a first speed to move refrigerant from the evaporator side to the condenser side. Optionally, the second pump down event comprises a second transfer stage, in which the compressor is operated at a second speed to move refrigerant from the evaporator side to the condenser side, the second speed being different to the first speed.

Optionally, the second pump down event is performed after the first pump down event. The second pump down event may alternatively be performed before the first pump down event.

Optionally, the second speed is higher than the first speed, for instance at least twice the first speed. The first speed may be between 10 Hz and 30 Hz, such as 20 Hz, and the second speed may be between 50 Hz and 70 Hz, such as 60 Hz. Alternatively, the first and second speeds may be any other suitable speeds.

Optionally, the first performance characteristic comprises a first peak pressure, or first peak pressure differential, determined during the first pump down event, and the second performance characteristic comprises a second peak pressure, or second peak pressure differential, determined during the second pump down event. Optionally, the one or more predetermined criteria being met comprises a difference between the first peak pressure differential and the second peak pressure differential meeting, or being below, a difference threshold.

The first and second peak pressure differentials are peak, such as maximum, pressure differentials between the evaporator side and the condenser side, such as at either side of the compressor and/or the expansion valve, during the pump down event. Where first and second peak pressures are used, these may be peak, such as maximum, pressures on the condenser side, such as downstream of the compressor. The first peak pressure differential and/or the second peak pressure differential may be, and may be determined, as described above for the pressure differential. Similarly, the first peak pressure and/or the second peak pressure may be, and may be determined, as described above for the condenser-side pressure.

In general, it may be more accurate to use pressure differentials, rather than condenser-side pressures, when determining the state of charge. This may be the case when comparing peak pressures or pressure differentials, and/or when determining the decay time as described above. In particular, the condenser-side pressure alone may start to plateau towards the end of the transfer stage, such as due to heat losses in the condenser side during the pump-down event. This may make it difficult to determine the peak and/or elevated condenser-side pressure at the end of the transfer stage. In contrast, the evaporator-side pressure may continue to decrease until the end of the transfer stage. Moreover, the evaporator-side pressure sensor may be more accurate than the condenser-side pressure sensor. In particular, the evaporator-side pressure sensor may be selected to be particularly accurate at relatively low pressures, such as encountered towards the end of the pump-down event. This may lead to the elevated and/or peak pressure differentials, which each involve both the condenser-side pressure and the evaporator-side pressure, being more readily identifiable than the elevated and/or peak condenser-side pressures alone. Moreover, by using pressure differentials, poor data may be more readily identified. For example, a pressure differential of value 1 might indicate that the compressor is not operating, and so there is no pressure build up in the condenser side. It will be understood, however, that any reference herein to a "pressure differential" may alternatively be a reference to a pressure in the condenser side, such as a pressure downstream of the compressor.

Operating the compressor at different speeds may cause different amounts of heat to be added to the refrigerant as it is moved from the evaporator side to the condenser side. For example, more heat may be added when the compressor is operated at a higher speed, particularly when the refrigeration system is charged at the nominal level of charge. This may lead to a different peak pressure differential during or following the transfer stage when the compressor is operated at different speeds. However, where there has been a loss of charge, and/or where the refrigeration system is undercharged, operating the compressor at different speeds may have less of an impact, or no impact, on an amount of heat added to the refrigerant, and/or any extra heat added by the compressor at higher speeds may be more quickly dissipated via the condenser, where provided. As such, where there has been a loss of charge, there may be a lower difference between the first peak pressure differential and the second peak pressure differential. Similarly, where the refrigeration system is undercharged relative to the nominal level of charge, there may be a lower difference between the first peak pressure differential and the second peak pressure differential than would be expected when the refrigeration system is charged at the nominal level of charge.

Alternatively, where there has been an increase in a level of charge, and/or where the refrigeration system is overcharged, operating the compressor at different speeds may have more of an impact on an amount of heat added to the refrigerant. Moreover, any extra heat added by the compressor at higher speeds may be less quickly dissipated via the condenser, where provided. As such, where there has been an increase in a level of charge, there may be a higher difference between the first peak pressure differential and the second peak pressure differential. Similarly, where the refrigeration is overcharged relative to the nominal level of charge, there may be a larger difference between the first peak pressure differential and the second peak pressure differential than would be expected when the refrigeration system is charged at the nominal level of charge.

Alternatively, the difference between the first and second peak pressures, or pressure differentials, is a ratio between the first peak pressure, or pressure differential, and the second peak pressure, or pressure differential. Optionally, the one or more predetermined criteria being met comprises the ratio, or an inverse thereof, meeting, exceeding or being below a ratio threshold.

Optionally, the difference threshold, and/or the ratio threshold, is predetermined. Alternatively, the difference threshold, and/or the ratio threshold, is determined based on a difference between a previous difference between the first pressure differential and a previous pressure differential determined during a previous pump down event. Alternatively, the difference threshold, and/or the ratio threshold, is, or is determined based on, a difference between two previous pressure differentials determined during respective previous pump down events. In this way, the difference threshold may be determined so as to enable a determination of a state (e.g., loss) of charge relative to a previous state of charge, e.g., charge level, of the system.

Optionally, the method comprises determining the first peak pressure differential, determining the second peak pressure differential, and determining the difference, or the ratio, between the first peak pressure differential and the second peak pressure differential. Optionally, the method comprises determining the difference threshold, and/or the ratio threshold.

Optionally, the first pump down event comprises a first maintenance stage in which refrigerant is prevented from flowing from the condenser side to the evaporator side, and in which refrigerant is prevented from flowing from the evaporator side to the condenser side, such as for a first period of time. Optionally, the second pump down event comprises a second maintenance stage, in which refrigerant is prevented from flowing from the condenser side to the evaporator side, and in which refrigerant is prevented from flowing from the evaporator side to the condenser side, such as for a second period of time. Optionally, the second period of time is the same as, or different to, the first period of time.

The first peak pressure, or pressure differential, may be attained at or near to a time at which the compressor is caused to stop operating during the first pump down event, such as at or towards an end the first transfer stage, or at or towards a start of the first maintenance stage, where these stages are performed. Similarly, the second peak pressure, or pressure differential, may be attained at or near to a time at which the compressor is caused to stop operating during the second pump down event, such as at or towards an end the second transfer stage, or at or towards a start of the second maintenance stage, where these stages are performed.

Optionally, the method comprises causing performance of an equalisation event, in which a pressure in the condenser side is equalised with a pressure in the evaporator side, between the first pump down event and the second pump down event (when performed). The equalising event may be performed after the first transfer stage and before the second transfer stage, and after the first maintenance stage (when performed). Optionally, the causing performance of the equalisation event comprises allowing refrigerant to flow from the condenser side to the evaporator side, such as by bypassing the expansion valve and/or the isolator valve (where provided). This may be by causing operation of a bypass valve that is fluidically connected, in a parallel fluidic arrangement with the expansion valve and/or the isolator valve (where provided), between the condenser side and the evaporator side.

By using peak pressure differentials to determine the state of charge, the first and second pump down events may be performed in quicker succession than, for example, when using decay times to determine the state of charge as described above. For instance, once a peak pressure differential has been determined during a respective pump down event, the equalisation event, and/or the second pump down event, may be performed without waiting for the pressure to reach the reduced pressure, as is required when using decay times to determine the state of charge. In this way, the determination of the state of charge may be quicker when using pressure differentials. This may also lead to a more accurate determination of the state of charge. In particular, it may reduce a likelihood of the pressure differential being affected, for example, by a change in an operating condition of the refrigeration system during one or each of the pump down events. Such a change in an operating condition may be a change in an ambient temperature of the ambient atmosphere surrounding the condenser, where provided, which may affect the pressure in the condenser side. Moreover, debris and/or deposits may build-up in the condenser, where provided, over time. This may partially clog the condenser and/or cause an increase in the pressure of refrigerant in the condenser, and thus the condenser side, in use. This increase in pressure may be large enough to compensate, for example, for a loss of pressure due to a leak in the refrigeration system, thereby potentially masking the detection of a leak if only a single pump-down event is performed. Performing two pump-down events in succession at different compressor speeds, and determining the state of charge based on peak pressure differentials during the pump down events, may therefore reduce the likelihood of the determination of the state of charge being affected by such a build-up of debris in the condenser.

Optionally, the method comprises causing performance of an initialisation event before the first pump down event. The initialisation event may comprise performing an equalisation event, as described above, and optionally performing a pump down event, or a part of a pump down event, as also described above, before the equalisation event.

The causing performance of the equalisation event and/or the initialisation event may ensure that the starting condition of the refrigeration system is the same, or substantially the same, prior to each of the first and second pump down events. This may permit a more accurate comparison between the first and second performance characteristics. This is particularly advantageous where the compressor is operated at the first speed during the first pump down event and at the second speed during the second pump down event.

Optionally, the method comprises causing performance of further equalisation and/or pump down events following the second pump down event. The further pump down events may comprise respective transfer stages, as described above, each transfer stage being performed by operating the compressor at a different speed to transfer stages of other pump down events. For example, a further pump down event may comprise a further transfer stage in which the compressor is operated at a speed between the first speed and the second speeds described above, such as at a speed between 10 Hz and 60 Hz, such as between 30 Hz and 50 Hz, such as 40 Hz, or at a speed below the first speed, or at a speed above the second speed. This may provide a more accurate determination of a state (e.g., loss) of charge of refrigerant in the refrigeration system.

Optionally, the refrigeration system comprises an evaporator, and the method is performed when the refrigeration system is being used to heat an external evaporator fluid being passed across, or through, the evaporator, in use. In other words, the method may be performed when the refrigeration system is being operated in a heating mode.

Optionally, the refrigeration system comprises a liquid receiver downstream of the condenser in the condenser side. The liquid receiver may be configured to store liquid refrigerant received from the condenser, which can then be passed to the expansion valve. The liquid receiver may act as a buffer to store excess refrigerant which may be present in the refrigeration system, such as due to changes in temperature external to the refrigeration system. In this way, the liquid receiver may allow the refrigeration system to operate efficiently under different and/or changing operating conditions when the refrigeration system is charged with a given, such as the nominal, level of charge. Such changing operating conditions, as described above, may include: a change in a temperature of an ambient atmosphere surrounding at least a part of the condenser side, such as a condenser in the condenser side; a change in a temperature of an atmosphere in a space that is conditioned by the refrigeration system, such as an atmosphere in the cargo space; and/or changing heat transfer demands of the refrigeration system. The liquid receiver may also ensure that the refrigerant supplied to the expansion valve is entirely, or predominantly, in a liquid phase.

A smaller liquid receiver may provide less of a buffering effect, and may result in a greater increase in pressure when the compressor is operated at a higher speed, and so may increase the difference in the first and second peak pressure differentials discussed above. As such, while a larger liquid receiver may help to improve a performance of the refrigeration system, a smaller liquid receiver may improve an accuracy and/or reliability of the determination of a state (e.g., loss) of charge. The liquid receiver may, for example, have a volumetric capacity of greater than 6 litres, up to 6 litres, up to 3 litres, up to 2 litres, or up to 1.5 litres. The liquid receiver may be a liquid-cooled receiver or an air-cooled receiver. The liquid receiver may be cooled by liquid and/or air that is external to the refrigeration system and/or the space. In this way, the air-cooled or liquid-cooled liquid receiver may act as a condenser in the condenser side, thereby improving an efficiency of the refrigeration system.

Optionally, the method comprises determining that a change (e.g., loss) of charge in the refrigeration system exceeds a charge threshold. For instance, the method may comprise determining a quantity of refrigerant that has been lost from and/or gained in the refrigeration system, and comparing the quantity to the charge threshold. The method may comprise taking remedial action when the loss and/or gain of charge exceeds the charge threshold. This may allow the refrigeration system to continue operating as normal in the event of a loss of an acceptable quantity of refrigerant.

Optionally, the charge threshold is a predetermined amount of refrigerant that can be lost from and/or gained in the refrigeration system. Optionally, the charge threshold is an amount of refrigerant that could be lost and/or gained while maintaining a level of performance of the refrigeration system within an allowable performance range. Optionally, the charge threshold is an amount of refrigerant that could be lost and/or gained without posing a safety risk, such as a fire hazard. For instance, the refrigeration system could be a refrigeration system for a transport unit comprising a space for storing cargo, and the charge threshold may be an amount of refrigerant that can safely be allowed to accumulate in the space. Optionally, the charge threshold is up to 1 kg of refrigerant, up to 1.5 kg of refrigerant, up to 2 kg of refrigerant, up to 3 kg of refrigerant, up to 4.5 kg of refrigerant, or more than 4.5 kg of refrigerant. Optionally, the charge threshold is determined based on a lower flammability limit of the refrigerant. The lower flammability limit is a relative volume of the refrigerant in the space and/or other areas of the transport unit, and may be dependent on a condition of gas in the space, such as a relative humidity, pressure, and/or temperature of the gas in the space. As such, the charge threshold may be determined based on the lower flammability limit, the condition of the gas in the space, an amount of cargo in the space, and/or an amount of gas in the space. Determining whether the change (e.g., loss) of charge exceeds the charge threshold may improve a safety and/or efficiency of the refrigeration system, such as by allowing an adjustment to the operation of the refrigeration system to be made based on the quantity of refrigerant that has been lost and/or gained.

Optionally, the method is performed periodically, such as at intervals of up to 4 hours, up to 8 hours, up to 16 hours, or more than 16 hours. Optionally, the method is performed when the refrigeration system is operating in a heating mode, such as to defrost any ice which may have built up on an external surface of the evaporator, where provided, and/or where there is no cooling demand from the refrigeration system, such as when the compressor is due to stop operating for a period of time.

A second aspect of the present invention provides a controller configured to perform the method of the first aspect. It will be appreciated that any of the optional features and advantages of the first aspect may similarly apply to the second aspect.

A third aspect of the present invention provides a non-transitory computer-readable storage medium storing instructions that, if executed by a processor, cause the processor to perform the method of the first aspect. Optionally, the processor is a processor of the controller of the second aspect. It will be appreciated that any of the optional features and advantages of the first aspect and/or the second aspect may similarly apply to the third aspect.

A fourth aspect of the present invention provides a refrigeration system comprising the controller of the second aspect, or the non-transitory computer-readable storage medium of the third aspect, the refrigeration system comprising the compressor, the expansion valve, the condenser side and the evaporator side. Optionally, the refrigeration system comprises a condenser in the condenser side and an evaporator in the evaporator side. Optionally, the refrigeration system comprises a liquid receiver in the condenser side, such as downstream of the condenser and upstream of the expansion valve. It will be appreciated that any of the optional features and advantages of any of the first to third aspects may similarly apply to the fourth aspect.

A fifth aspect of the present invention provides an atmosphere control system comprising the refrigeration system of the fourth aspect. It will be appreciated that any of the optional features and advantages of any of the first to fourth aspects may similarly apply to the fifth aspect.

A sixth aspect of the present invention provides a storage unit comprising the refrigeration system of the fourth aspect, and space for storing cargo, the refrigeration system being operable to condition an atmosphere in the space.

Optionally, the storage unit comprises the atmosphere control system of the fifth aspect. Optionally, the atmosphere control system is configured to control the atmosphere in the space. Optionally, the atmosphere control system is configured to provide cooled gas to the space. Optionally, the refrigeration system is operable so that the gas supplied to the space is cooled by the evaporator of the refrigeration system, where provided. Optionally, the storage unit is a reefer container, or a refrigerated truck or trailer.

It will be appreciated that any of the optional features and advantages of any of the first to fifth aspects may similarly apply to the sixth aspect.

A seventh aspect of the present invention provides a marine vessel comprising the controller of the second aspect, the non-transitory computer-readable storage medium of the third aspect, or the refrigeration system of the fourth aspect. Optionally, the marine vessel comprises the atmosphere control system of the fifth aspect, or the storage unit of the sixth aspect.

It will be appreciated that any of the optional features and advantages of any of the first to sixth aspects may similarly apply to the seventh aspect.

BRIEF DESCRIPTION OF DRAWINGS

Embodiments of the invention will now be described, by way of example only, with reference to the accompanying drawings, in which.

DETAILED DESCRIPTION

Figure 1:
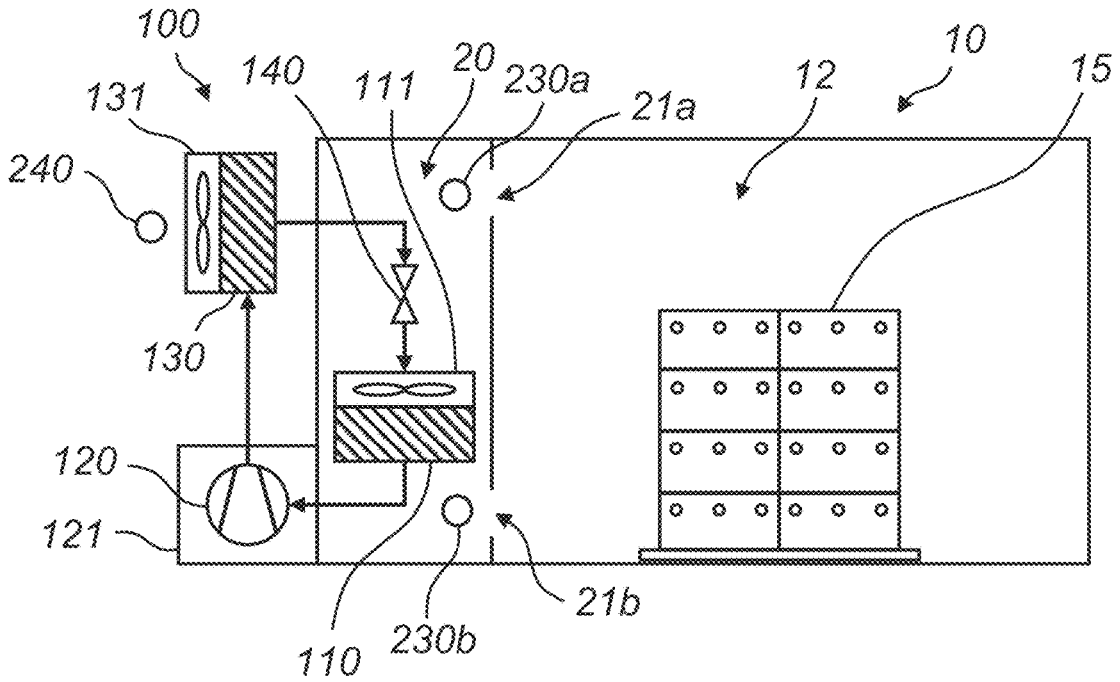
FIG. 1 shows a storage unit comprising a refrigeration system, according to an example.

FIG. 1 shows an example storage unit 10, which here is a transport unit 10, for transporting cargo 15. Specifically, the transport unit 10 is a reefer container for transporting the cargo 15 on a marine vessel, but may alternatively be a refrigerated truck or trailer. In other examples, the storage unit 10 may be any other suitable storage unit 10, such as a storage unit for storing the cargo 15 in in a ripening warehouse or other facility.

The cargo 15 in the illustrated example is fresh or frozen produce. This may include respirating and/or ripenable produce, such as fruit and vegetables, and/or non-respirating fresh produce, meat and/or fish. In other examples, the storage unit 10 may be for transporting any other suitable cargo 15, for example medicaments, such as vaccines. It will be appreciated, however, that the cargo 15 may be any other suitable cargo 15, and may advantageously be cargo 15 that requires, or benefits from, being stored in an atmosphere-controlled space.

The storage unit 10 comprises a space 12 for storing the cargo 15, and an atmosphere control system 20 for controlling an atmosphere in the space 12. Specifically, the atmosphere control system 20 is configured to supply conditioned gas, such as cooled or heated gas, or gas with a specific composition, into the space 12, such as through one or both of a first port 21*a* and a second port 21*b* that each open into the space 12, or via any other suitable fluidic connection between the atmosphere control system 20 and the space 12. In other examples, the atmosphere control system 20, or a part thereof, is located in the space 12.

The illustrated atmosphere control system 20 comprises a refrigeration system 100 configured to condition the gas to be the supplied to the space 12. Specifically, the refrigeration system 100 comprises an evaporator 110, which acts as a heat exchanger to cool gas supplied to the space. The refrigeration system 100 comprises an evaporator gas moving device 111, which here is a fan 111, to draw the gas through, or across, the evaporator 110. The evaporator 110 comprises a fin-and-tube heat exchanger for exchanging heat between a refrigerant flowing in the evaporator 110 and the gas passed through the evaporator 110, but may alternatively be of any other suitable construction.

The evaporator gas moving device 111 is specifically configured to draw gas from the space 12, such as through the second port 21*b*, and to supply gas conditioned by the evaporator 110 to the space 12, such as through the first port 21*a*. The evaporator gas moving device 111 may be selectively operable in a forward and a reverse direction, such as to change which of the first and second ports 21*a*, 21*b* the conditioned gas is supplied to and/or received from. In other examples, the evaporator 110 and/or the evaporator gas moving device 111 may be located in the space 12.

The refrigeration system 100 also comprises a compressor 120, a condenser 130, a condenser gas moving device 131 and an expansion valve 140. The compressor 120 is shown located in a compartment 121 of the storage unit 10, but may alternatively be in any other suitable location, such as within the atmosphere control system 20 compartment, within the space 12, or in the compartment 121. The condenser 130 is located so as to interface with an external atmosphere surrounding the storage unit 10. This is to permit heat to be exchanged between refrigerant in the condenser 130 (which, as with the evaporator 110, may comprise a fin-and-tube heat exchanger or any other suitable heat exchanger), and an external atmosphere surrounding the storage unit (herein an "ambient atmosphere"). The expansion valve 140 is located within the atmosphere control system 20 and inside the storage unit 10, but may alternatively be located in any other suitable location.

The components of the refrigeration system 100 are fluidically coupled by respective conduits, which are shown as directional arrows in FIG. 1. The conduits are configured to pass refrigerant between the respective components, specifically in the direction of the arrows. A person skilled in the art of refrigeration systems will understand the principles of operation of the refrigeration system 100; however, for the avoidance of doubt, one mode of operation is described here.

The compressor 120 is operable to provide refrigerant in the form of a high-pressure, high-temperature gas to the condenser 130. That is, the condenser is on a "high-temperature" side of the refrigeration system 100. It will be understood that the term "high", here, is with respect to refrigerant being passed through the evaporator 130, which is on a "low-temperature" side of the refrigeration system 100. The temperature of the refrigerant in the condenser is higher than that of the ambient atmosphere. As such, latent heat stored in the refrigerant is transferred to the ambient atmosphere to cause the refrigerant to at least partly condense as it passes through the condenser 130. The refrigerant is supplied to the expansion valve 140 from the condenser 130 in a liquid phase, or part-liquid, phase. The refrigerant may be "subcooled" in the condenser, which is to lower the temperature of the refrigerant to below its saturation temperature at the pressure in the condenser 130. That is, sensible heat from the liquid refrigerant may be transferred to the ambient atmosphere to subcool the refrigerant upstream of the evaporator. For this reason, the conduit connecting the condenser 130 and the expansion valve 140 may be referred to herein as the "liquid line".

The expansion valve comprises an orifice through which the refrigerant is passed to reduce a pressure of the refrigerant entering the evaporator 110. The drop in pressure reduces a saturation temperature of the refrigerant, causing at least some of the liquid refrigerant to change phase into a vapour. This change of phase causes a reduction in temperature of the refrigerant, as some of the sensible heat in the refrigerant is converted into latent heat. The expansion valve 140 is here an electronically-controlled expansion valve, which may provide improved control of the expansion of refrigerant in the expansion valve. In other examples, the expansion valve is a thermal expansion valve ("TEV"), a manual valve, a capillary tube, or any other suitable type of expansion valve.

The low-temperature, two-phase refrigerant from the expansion valve 140 is passed through the evaporator 130, where any remaining liquid in the refrigerant is evaporated. Specifically, the refrigerant receives heat from the external gas, or "external fluid", being passed through the evaporator 130 due to the action of the evaporator gas moving device 131. This heat is stored as latent heat in the refrigerant as the refrigerant is evaporated, thereby removing heat from the external gas, which is then passed into the space 12 of the storage unit 10. The refrigerant is "superheated" in the evaporator, meaning it is elevated to a temperature above its saturation temperature at the pressure in the evaporator 130, or in the "suction line" leading from the evaporator back to the compressor 120. This ensures that any refrigerant entering the compressor 120 is fully evaporated, because any liquid refrigerant entering the compressor 120 may reduce an efficiency and/or longevity of the compressor 120.

Figure 2:
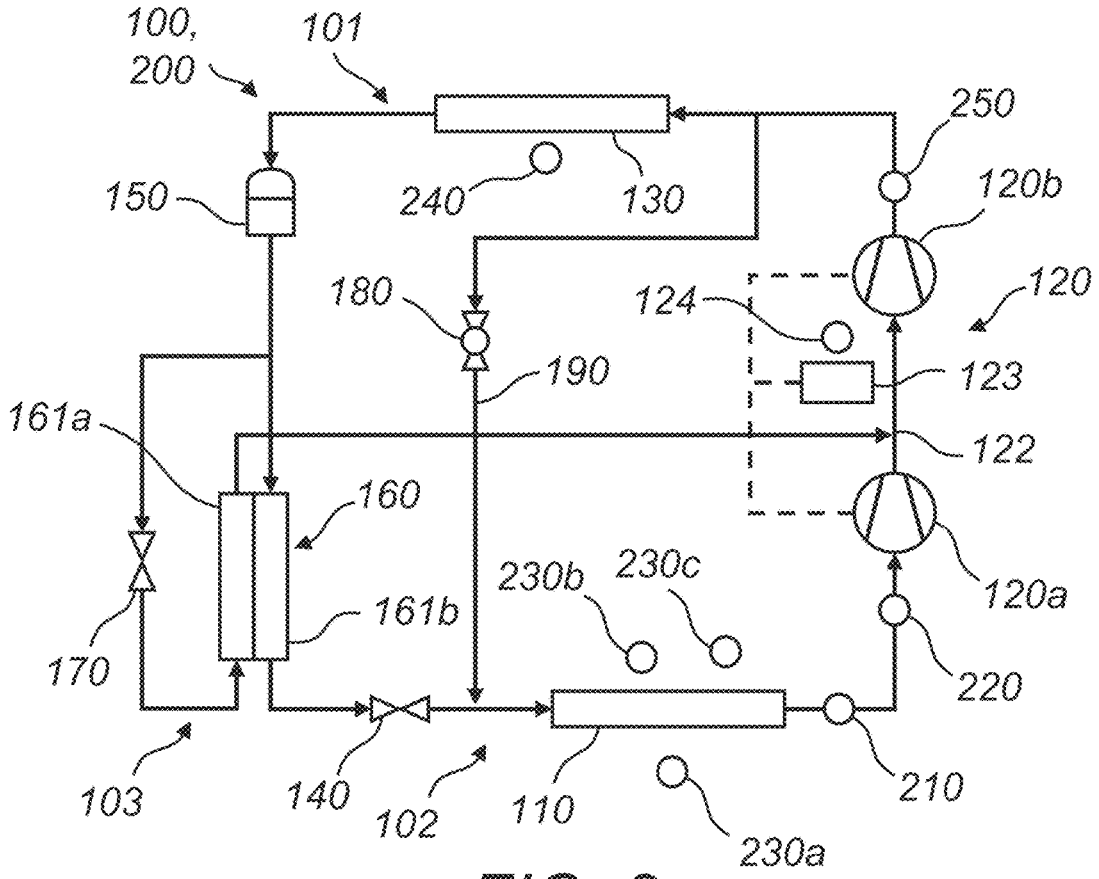
FIG. 2 shows an example refrigeration system of the storage unit of FIG. 1.

Turning now to FIG. 2, shown is a more detailed schematic diagram of the refrigeration system 100 shown and described in relation to FIG. 1. Specifically, the refrigeration system 100 of the present example comprises further components which have been omitted from FIG. 1 for clarity. Specifically, the refrigeration system 100, as shown in FIG.

2, comprises a two-stage compressor 120, specifically a two-stage piston compressor 120, comprising a compressor low stage 120*a* and a compressor high stage 120*b*. The compressor low stage 120*a* is configured to receive low-pressure, low-temperature refrigerant leaving the evaporator 110, while the compressor high stage 120*b* is configured to supply high-pressure, high-temperature refrigerant to the condenser 130.

The refrigeration system 100 comprises a liquid receiver 150 located in the liquid line connecting the condenser 130 and the expansion valve 140. The liquid receiver 150 is configured to store liquid received from the condenser 130, which can then be passed to the expansion valve 140. This can be to store excess refrigerant which may be present in the refrigeration system 100, such as due to changes in operating conditions of the refrigeration system, such as changes in a temperature of the ambient atmosphere and/or a temperature of the external gas that is passed through the evaporator 130, and/or due to changes in a heat transfer demand of the refrigeration system. In particular, at higher temperatures of the ambient atmosphere and/or the external gas, and/or at increased heat transfer demands, the temperature, and thus pressure, of refrigerant in the condenser 130 and/or evaporator 110 may be correspondingly high. This may reduce a density of the refrigerant, meaning that more refrigerant is required to fill the volume(s) in the condenser 130 and/or the evaporator 110. This extra refrigerant may be stored and/or provided by the liquid receiver 150. For instance, during an initial pull-down of a temperature in the space 12, such as where heat transfer demands are high, the temperature of the external gas is relatively high, such as up to 45° C., and/or the temperature of the ambient atmosphere is relatively high, such as up to 45° C., then most, or all, of the refrigerant may be in the evaporator 110 and/or condenser 130, and the liquid receiver 150 may be empty, or close to empty. In contrast, during a steady state operation of the refrigeration system, such as where heat transfer demands are moderate to low, the temperature of the external gas is relatively low, such as −20° C., and/or the temperature of the ambient atmosphere is relatively low, or moderate, such as 25° C., then more liquid refrigerant may be present the liquid receiver 150 than during the initial pull-down event. The liquid receiver 150 may also ensure that the refrigerant supplied to the expansion valve 140 is entirely in a liquid phase. This may improve a performance of the refrigeration system 100.

In the present example, the liquid receiver 150 is an air-cooled liquid receiver, or, more generally, a gas-cooled liquid receiver. That is, the liquid receiver 150 is cooled by gas that is passed over the liquid receiver in use. The liquid receiver 150 may be located such that gas from the space 12, or conditioned gas that is to be provided to the space 12, or external gas, is passed over the liquid receiver 150, in use, to cool the liquid receiver (and refrigerant contained therein). In other examples, the liquid receiver 150 may be a liquid-cooled liquid receiver. That is, the liquid receiver may be cooled by a cooling liquid, such as by a refrigerant from the refrigeration system 100 or another refrigeration system. In some examples, the liquid-cooled liquid receiver is a water-cooled liquid receiver. In some such examples, particularly on vessels such as marine vessels, water pipes may be connected to the receiver to transfer rejected heat from the receiver through a water pipe system of the vessel. In this way, the liquid receiver may act as a further condenser in the condenser side 101. This may improve an efficiency of the refrigeration system 100 and/or allow lower temperatures to be achieved in the space 12.

The refrigeration system 100 also comprises an economiser heat exchanger 160, which is located between the liquid receiver 150 and the expansion valve 140, and an economiser expansion valve 170. The economiser expansion valve 170 is configured to receive and "expand" some of the liquid refrigerant from the liquid receiver 150. That is, some of the refrigerant passing through the liquid line is tapped off and passed through the economiser expansion valve 170. The refrigerant expanded in the economiser expansion valve 170 is passed through a first side 161*a* of the economiser heat exchanger 160, while refrigerant from the liquid receiver 150 is passed through a second side 161*b* of the economiser heat exchanger 160 towards the expansion valve 140. The refrigerant passed through the first side 161*a* of the economiser heat exchanger 160 is at a lower temperature than the refrigerant passed through the second side 161*b*, due to its expansion through the economiser expansion valve 170. This causes further sub-cooling of the refrigerant passed to the expansion valve 140, which can improve an overall efficiency of the refrigeration system 100.

The refrigerant from the economiser expansion valve 170 is evaporated in the economiser heat exchanger 160 and is received by the compressor high stage 120*b*, such as via an economiser port 123 of the compressor 120. It will be understood that the economiser port 123 may open into the compressor 120 at a location such that a pressure at the economiser port 123 is between a pressure at an inlet of the compressor low stage 120*a* and an outlet of the compressor high stage 120*b*. In this way, a pressure drop across the economiser expansion valve 160 is lower than a pressure drop across the expansion valve 170, but is sufficient to enable further sub-cooling of the refrigerant entering the expansion valve 170. In some examples, refrigerant from the economiser expansion valve 140 and the first side 161*a* of the economiser heat exchanger 160 is used to reduce a temperature of a frequency convertor 123 of the compressor 120. The frequency convertor 123 shown in FIG. 2 is configured to drive respective motors of the compressor low stage 120*a* and compressor high stage 120*b*. The frequency convertor 123, or a part thereof, is located in proximity to the economiser port 122, so that heat can be exchanged between the frequency convertor 123 and the refrigerant from the economiser port 122. In some examples, this is to maintain the temperature of the frequency convertor 123, such as sensed by a frequency converter temperature sensor 124 below a predetermined temperature threshold of the frequency converter 123.

Herein, the part of the refrigeration system 100 comprising the condenser 130, and which is for passing refrigerant from the compressor 120 to the expansion valve 140 and to the economiser expansion valve 170, may be referred to as the "condenser side 101". The condenser side 101 here comprises the second side 161*b* of the economiser heat exchanger 160. The part of the refrigeration system 100 comprising the evaporator 110, and which is for passing refrigerant from the expansion valve 140 to the compressor 120, may be referred to as the "evaporator side 102", while the part of the refrigeration system 100 comprising the first side of the economiser 161*a*, and which is for passing refrigerant from the economiser expansion valve 170 to the compressor 120, may be referred to as the "economiser side 103".

The refrigeration system also comprises a bypass valve 180 that is operable to selectively permit refrigerant to pass along a bypass line 190 from the condenser side 101, specifically from a location downstream of the compressor 120 and upstream of the condenser 130, to the evaporator side 102, specifically to a location downstream of the expansion valve 140 and upstream of the evaporator 110. The bypass valve 180 is here an electronically controlled solenoid valve, but may be any other suitable valve, such as a selector valve located in a line between the compressor 120 and the condenser 130. In other examples, the bypass line 190 and isolation valve 180 are configured to pass refrigerant from any other suitable point in the condenser side 101, such as downstream of the condenser 130, to any other suitable point in the evaporator side 102, such as downstream of the evaporator 110.

The refrigeration system 100 comprises a sensor system 200 comprising various sensors for sensing thermofluidic parameters and/or performance characteristics of the system. Specifically, the refrigeration system 100 comprises a suction line temperature sensor 210 located between the evaporator 130 and the compressor low stage 120*a* and configured to sense a temperature of refrigerant in, or leaving the evaporator 130. The refrigeration system 100 also comprises a suction line pressure sensor 220 located in the suction line between the evaporator 130 and the compressor low stage 120*a*. The suction line pressure sensor 220 can be used to determine a pressure of refrigerant in the low-temperature side of the refrigeration system 100, such as a pressure of the refrigerant in, and/or leaving the evaporator 130. The pressure sensed by the suction line pressure sensor 220 can be used to infer a saturation temperature of the refrigerant in the evaporator 130. The saturation temperature can then be compared to the temperature sensed by the suction line temperature sensor 210 to determine a level of superheat of the refrigerant. The expansion valve 140 may be controlled on the basis of the determined superheat, such as to increase or decrease a pressure drop across the expansion valve 140, and/or to adjust a quantity of refrigerant supplied to the evaporator, such as to adjust the superheat to a target superheat set point.

The sensor system 200 also comprises a supply gas temperature sensor 230*a* and a return gas temperature sensor 230*b*. As shown in FIG. 1, the supply gas temperature sensor 230*a* is located downstream of the evaporator 110 with respect to the external gas flowing through the atmosphere control system 20 when the gas is received from the space 12 via the second port 21*b* and supplied to the space 12 via the first port 12*a*. Similarly, the return gas temperature sensor 230*b* is located upstream of the evaporator 110 with respect to the external gas flowing through the atmosphere control system 20 when the gas is received from the space 12 via the second port 21*b* and supplied to the space 12 via the first port 12*a*. In other words, the return gas temperature sensor 230*b* is configured to sense a temperature of "return" gas received by the atmosphere control system 20 from the space 12, while the supply gas temperature sensor 230*a* is configured to sense a temperature of "supply" gas supplied to the space 12 by the atmosphere control system 20. As such, if the external gas from the space 12 is passed through the atmosphere control system, such as by operating the evaporator gas moving device 111 in a reverse direction, then the supply and return gas temperature sensors 230*a*, 230*b* may be correspondingly switched. In other examples, the supply and return gas temperature sensors 230*a*, 230*b* may be located in any other suitable location in the storage unit 10, such as in or near the respective first and second ports 21*a*, 21*b*. In some examples, there may be more than one supply gas temperature sensor 230*a*, and/or more than one return gas temperature sensor 230*b*, which may each located in different parts of the atmosphere control system 20 and/or the storage unit 10.

The sensor system 200 also comprises a relative humidity sensor 230*c* configured to determine a relative humidity of (i.e., a water content of) the external gas flowing through the evaporator 110. The relative humidity sensor 230*c* is shown in FIG. 2 as being on the same side of the evaporator 110 as the return gas temperature sensor 230*b*, such as to sense a relative humidity of the return gas. However, as with the supply and return gas temperature sensors 230*a*, 230*b*, the relative humidity sensor 230*c* may be located in any suitable location in the atmosphere control system 20 and/or storage unit 10, such as upstream or downstream of the evaporator 110, which, in some examples, may depend on the direction of flow of the external gas across the evaporator 110.

The sensor system 200 also comprises an ambient temperature sensor 240 configured to sense a temperature of the ambient atmosphere surrounding the storage unit. More specifically, the ambient temperature sensor 240 is located, as shown in FIG. 1, near to the condenser 130 in order to sense a temperature of the ambient atmosphere being moved through the condenser 130 by the condenser gas moving device 131.

Finally, the sensor system 200 comprises a discharge pressure sensor 250 located between the compressor high stage 120*b* and the condenser 130 and configured to sense a pressure of refrigerant discharged by the compressor high stage 120*b*.

It will be understood that, in other examples, the refrigeration system 100 may comprise any other suitable sensor system 200, such as a sensor system containing only one or a subset of the sensors in the sensor system 200 shown in FIG. 2, and/or any other sensors particular to the application at hand, such as mass flow sensors, or a liquid level sensor to sense a level of liquid refrigerant in the liquid receiver 150. It will be appreciated that any one or more of the components of the illustrated refrigeration system 100 may be omitted and/or replaced with other components. For instance, there may be no liquid receiver 150, no economiser heat exchanger 160 or economiser expansion valve 160, and/or the compressor 120 may be only a single-stage compressor, optionally still comprising an economiser port 122. Other configurations of the refrigeration system 100 not described here may be conceivable.

Figure 3A:
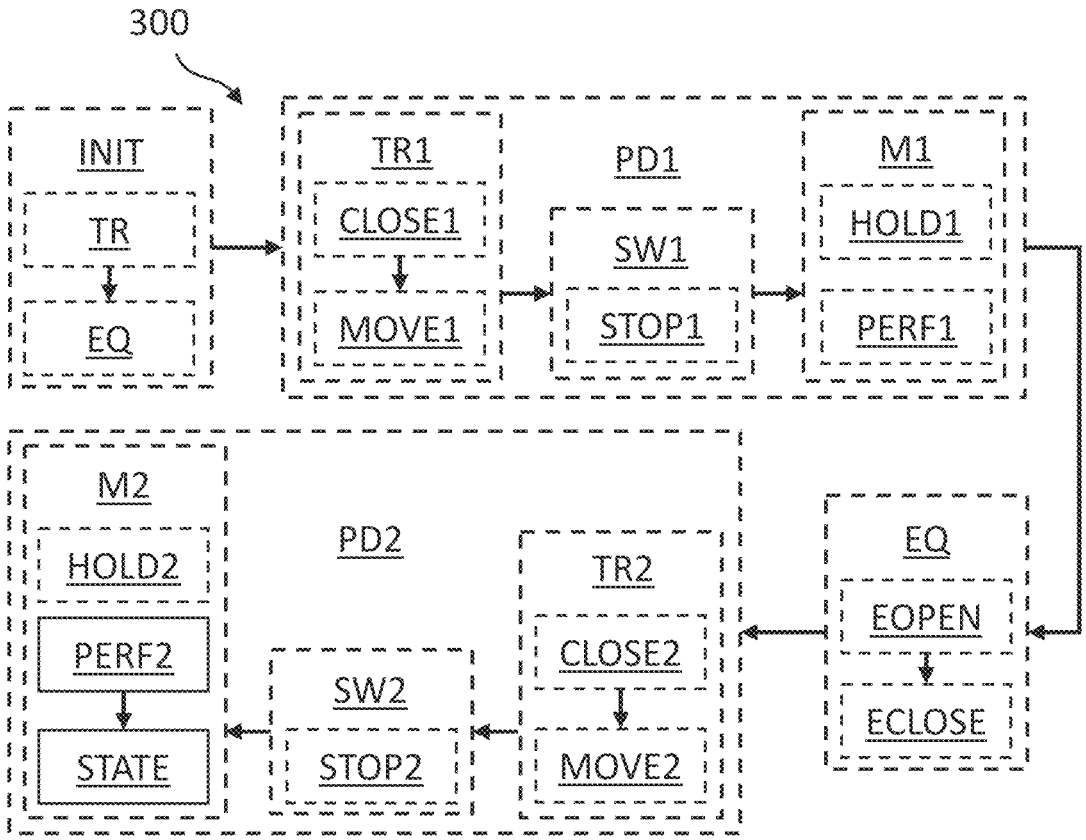
FIG. 3*a* shows an example method of determining a state, and more specifically a loss, of charge in the refrigeration system of FIGS. 1 and 2.

Turning now to FIG. 3*a*, shown is an example method 300 of determining a state, such as a loss, of charge of refrigerant in the refrigeration system 100. Specifically, the method comprises determining PERF2 at least one performance characteristic of the refrigeration system when refrigerant is prevented from flowing into the evaporator side 102 from the condenser side 101; and, when one or more predetermined criteria are met on the basis of the performance characteristic, determining STATE a state, such as a loss, of charge in the refrigeration system 100.

As will be described in more detail below with reference to FIGS. 4*a*, 4*b* and 5, in various examples, the at least one performance characteristic comprises one or more of: a pressure in the condenser side 101; a pressure differential, such as a difference, or ratio, between the condenser side 101 and the evaporator side 102; and a decay time between two or more such pressure differentials. The, or each, pressure differential is here a pressure differential across the compressor 120. The, or each, pressure differential comprises a difference (in other examples, a ratio) between: a condenser-side pressure downstream of the compressor 120, in the condenser side 101, such as sensed by the discharge pressure sensor 220; and an evaporator-side pressure upstream of the compressor 120, in the evaporator side 102, such as sensed by the suction line pressure sensor 220. In other examples, however, the, or each, pressure differential is instead a ratio between the condenser-side pressure and the evaporator-side pressure. As will also be described below, the one or more predetermined criteria being met comprises the at least one performance characteristic meeting, exceeding, or being below a predetermined threshold performance characteristic.

The illustrated method 300 comprises causing PD2 performance of a pump down event. The pump down event comprises a transfer stage, in which refrigerant is prevented from flowing into the evaporator side 102 (and optionally also the economiser side 103) from the condenser side 101, and refrigerant in the evaporator side 102 (and optionally also the economiser side 103) is moved from the evaporator side 102 to the condenser side 101, so that the system reaches a pumped-down state. The pump down event is performed to move, or transfer, some, most, or all of the refrigerant from the evaporator side 102 to the condenser side 101. The pumped-down state is achieved when an evaporator-side pressure in the evaporator side 102 meets, or is below, a predetermined evaporator-side pressure threshold, which here is a saturation pressure of the refrigerant at a temperature of −45 C, but may alternatively be any other suitable evaporator-side pressure threshold. In some examples, the refrigerant is R1234yf, R134a, R513A, or any other suitable refrigerant. In some such examples, the evaporator-side pressure threshold is less than 0.4 bar, less than 0.45 bar, or up to or greater than 0.5 bar. In this way, no, or only a residual amount of, refrigerant may remain in the evaporator side 102 in the pumped-down state following the pump down event. It will be appreciated that the evaporator-side pressure threshold may be any other suitable value. For example, the evaporator-side pressure threshold may be set so that some refrigerant still remains in the evaporator side following the pump-down event.

To cause PD2 performance of the pump down event, the method 300 comprises performing TR2 the transfer stage, by causing CLOSE2 the refrigerant to be prevented from flowing into the evaporator side 102, and optionally also the economiser side 103, from the condenser side 101, specifically by causing the expansion valve 140 and the economiser expansion valve 170 to close. The method 300 then comprises causing MOVE2 the refrigerant to be moved from the evaporator side 102, and optionally also the economiser side 103, to the condenser side 101, specifically by causing operation of the compressor 102 until the pumped-down state is reached. In some examples, the refrigeration system 100 comprises an isolation valve (not shown) upstream of the expansion valve 140, and the causing CLOSE2 the refrigerant to be prevented from flowing into the evaporator side 102 from the condenser side 101 comprises causing the isolation valve to close. A similar isolation valve may be provided for preventing a flow of refrigerant to the economiser expansion valve 170, or a common isolation valve may be provided to prevent a flow of refrigerant to both the expansion valve 140 and the economiser expansion valve 170.

The pump down event further comprises, following the transfer stage, a maintenance stage, in which the method 300 comprises causing HOLD2 refrigerant to be prevented from flowing into the evaporator side 102 from the condenser side 101, and from the evaporator side 102 to the condenser side 101. The method 300 comprises switching SW2 from the transfer stage to the maintenance stage, by causing STOP2 refrigerant to be prevented from flowing from the evaporator side 102 to the condenser side 101, specifically by causing the compressor 120 to stop operating once the pumped-down state is achieved. The determining PERF2 the at least one performance characteristic and the determining STATE a state, such as a loss, of charge is performed during the pumped-down state, specifically during the maintenance stage, when the compressor 120 is not operating. In other examples, the state of charge may be determined during the transfer stage, such as just before the compressor stops operating.

In the illustrated example, the pump down event is a second pump down event, the transfer stage is a second transfer stage, and the maintenance stage is a second maintenance stage. The method 300 then comprises performing PD1 a first pump down event before the second pump down event. In some examples, the first pump down event is performed after the second pump down event. The performing PD1 the first pump down event specifically comprises performing TR1 a first transfer stage, comprising, as with the second pump down event, causing CLOSE1 refrigerant to be prevented from flowing into the evaporator side 102 from the condenser side 101, and causing MOVE1 the refrigerant to be moved from the evaporator side 102 to the condenser side 10. Similarly, the performing PD1 the first pump down event further comprises performing M1 a first maintenance stage, comprising causing HOLD1 refrigerant to be prevented from flowing into the evaporator side 102 from the condenser side 101. The maintenance stage is maintained until a temperature of refrigerant in the condenser side 101 is within a predetermined range of a temperature of the external condenser fluid surrounding the condenser 130, but in other examples may be maintained for any other suitable period of time. The performing PD1 the first pump down event further comprises switching SW1 from the first transfer stage to the first maintenance stage by causing STOP1 refrigerant to be prevented from flowing from the evaporator side 102 to the condenser side 101, specifically by causing the compressor 120 to stop operating once the pumped-down state, or any suitable state, is achieved.

The at least one performance characteristic determined during the second pump down event comprises a second performance characteristic, and the method 300 comprises determining PERF1 a first performance characteristic during the first pump down event. In other words, the at least one performance characteristic comprises a first performance characteristic determined during the first pump down event, and a second performance characteristic determined during the second pump down event. It will be appreciated that the determining PERF1, PERF2 the respective first and second performance characteristics may be performed in the respective first and second transfer stages, in the respective first and second maintenance stages, and/or during the respective switching between the first and second maintenance and transfer stages.

Between the first and second pump down events, the method 300 comprises causing EQ performance of an equalisation event, in which a pressure in the condenser side 101 is equalised with a pressure in the evaporator side 102, by allowing refrigerant to flow from the condenser side 101 to the evaporator side 102. This is specifically by causing EOPEN the bypass valve 180 to open. During the equalisation event, the expansion valve 140 and the economiser expansion valve 170 remain closed, which may advantageously limit an amount of liquid refrigerant being passed to the evaporator 110 during the equalisation event. However, it will be appreciated that, in other examples, either one of the expansion valve 140 and the economiser expansion valve 170 may be opened as well as, or instead of, the bypass valve 180. The method 300 shown comprises, once the evaporator-side and condenser-side pressures have equalised, or once a pressure differential between the condenser side 101 and the evaporator side 102 reaches a predetermined equalisation threshold, causing ECLOSE the bypass valve 180 to close. The second pump down event is then performed once the bypass valve 180 is closed.

In some examples, the method 300 comprises, before the first pump down event, causing INIT performance of an initialisation event. The initialisation event comprises causing performance of a transfer stage TR, such as described above, followed by an equalisation stage EQ, again such as described above. The initialisation and equalisation events ensure that the starting condition of the refrigeration system 100 is the same prior to each of the first and second pump down events.

Figure 4A:
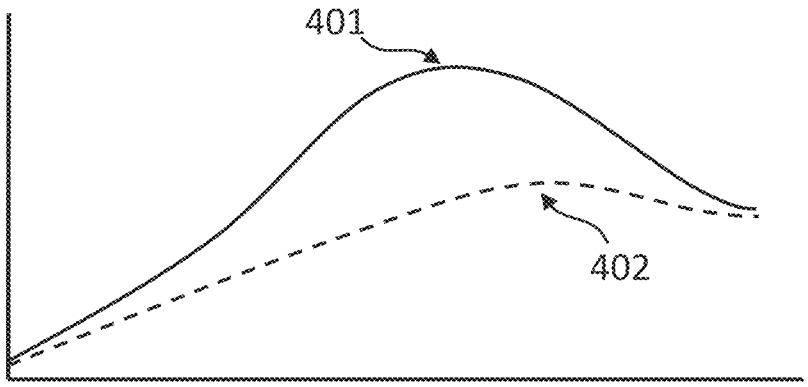
FIGS. 4*a* and 4*b* show charts of pressures during an operation of the refrigeration system shown in FIGS. 1 and 2, according to an example.
Figure 4B:
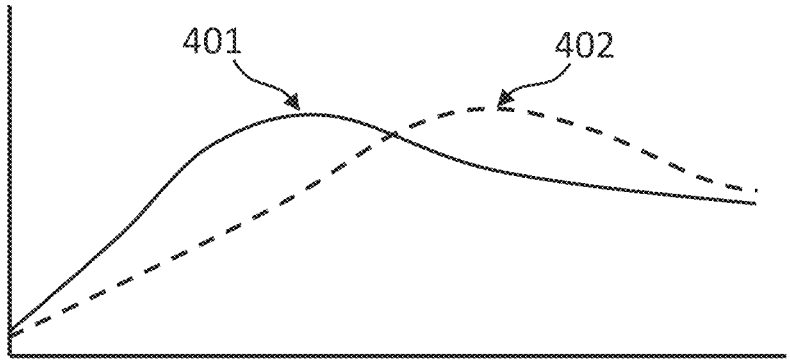

Example states of the refrigeration system 100 during the first and second pump down events are best illustrated in FIGS. 4*a* and 4*b*, which show the variation in a pressure differential over time in each of the first and second pump down events, under different levels of charge of refrigerant in the refrigeration system. Specifically, the solid curve 401 shows the variation in the pressure differential over at least a part of the first pump down event, and the dashed curve 402 shows the variation in the pressure differential over at least a part of the second pump down event. It will be understood that the shapes of the curves in FIGS. 4*a* and 4*b* are explanatory only, and the behaviour of the pressure differential, or condenser-side pressure, may differ from that shown, in use.

A level of charge of refrigerant in the refrigeration system 100 in FIG. 4*b* is less than a level of charge of refrigerant in FIG. 4*a*. In FIG. 4*a*, the refrigeration system 100 is at a nominal level of charge, which is here a level of charge at which the refrigeration system 100 is designed to be used. This may correspond to a rating of the refrigeration system 100. That is, in FIG. 4*a*, the refrigeration system 100 may be considered "sufficiently charged", or "nominally charged". In some examples, the nominal level of charge is a nominal level of charge range, within which the refrigeration system 100 is considered to be nominally charged. In other examples, the nominal level of charge is any other level of charge, such as a level of charge defined by a user, and/or a level of charge when a previous determination of a state of charge was performed. In FIG. 4*b*, a level of charge of the refrigeration system 100 is below the nominal level of charge, which may be a level of charge at which the refrigeration system 100 is designed to be used. This may, for example, be due to a leakage of refrigerant from, or a loss of integrity of, the refrigeration system 100. That is, in FIG. 4*b*, the refrigeration system 100 may be considered "insufficiently charged", or "undercharged". In other examples, in FIG. 4*b*, the refrigeration system 100 may have lost some refrigerant but may still be considered sufficiently charged. That is, in FIG. 4*b*, the refrigeration system 100 may have lost some refrigerant, but the level of charge may still be within the nominal level of charge range.

It can be seen that, in each case, the pressure differential is the same, or substantially the same, at the start of the respective pump down events, due to the initialisation and equalisation events described above. The pressure differential in each case increases during the respective first and second transfer stages as the refrigerant is moved to the condenser side, thereby reducing the evaporator-side pressure and increasing the condenser side pressure. The refrigerant is also heated by the compressor 120 as it is moved, further increasing a pressure of the refrigerant in the condenser side. In a similar way, where condenser-side pressures are used, then the condenser-side pressure may increase in each case as the refrigerant is moved to the condenser side.

The pressure differential in each case then decreases during the respective first and second maintenance stages, when the compressor 120 is switched off. This is due to a transfer of heat from the refrigerant in the condenser side 101 to the ambient atmosphere surrounding the condenser 130, which causes the condenser-side pressure to drop. Although not shown in FIG. 3, in some examples the method 300 comprises causing operation of the condenser gas moving device 131 during the first and second pump down events, and particularly during the first and second maintenance events. The condenser gas moving device in such examples is operated at up to 50%, up to 80%, or up to 100% of a maximum operating speed of the condenser gas moving device during the pump down event. This may ensure a flow of the ambient atmosphere across the condenser 130 is the same during each pump-down event, and that the relative effects of any external influences, such as wind speed, are reduced.

In each case, the pressure differential reaches a peak pressure differential, specifically a first peak pressure differential 401 during the first pump down event, and a second peak pressure differential 402 during the second pump down event. It will be appreciated that the first and second peak pressure differentials 401, 402 may be reached at the end of the transfer stage, during the switching stage, and/or at the start of the maintenance stage. Where condenser-side pressures are used, the pressure reaches a first peak condenser-side pressure during the first pump down event and a second peak condenser-side pressure during the second pump down event, such as at the end of the respective transfer stages, during respective switching stages, and/or at the start of respective maintenance stages.

In each of FIGS. 4*a* and 4*b*, during the first transfer stage of the first pump down event, the compressor 120 is caused to operate at a first speed, and during the second transfer stage of the second pump down event, the compressor 120 is caused to operate at a second speed, different to the first speed. In the example shown, the second speed is higher than the first speed, though in other examples the second speed may be lower than the first speed. The first speed is the same in FIG. 4*a* as in FIG. 4*b*, as is the second speed. Specifically, the first speed in each case is 20 Hz, and the second speed is 60 Hz, though in other examples the first and second speeds may be any other suitable speeds.

It can be seen that, when the refrigeration system 100 is "nominally charged", as in FIG. 4*a*, the first peak pressure differential 401 is higher than the second peak pressure differential 402. However, when there has been a loss of charge of refrigerant, and/or when the refrigeration system 100 is undercharged, as in FIG. 4*b*, there is little to no difference between the first and second peak pressure differentials 401, 402. This may be because, where there has been a loss of charge, operating the compressor 120 at different speeds may have less of an impact, or no impact, on an amount of heat added to the refrigerant, and/or any extra heat added by the compressor 120 at higher speeds may be more quickly dissipated via the condenser 130. In one example, the determining PERF1 the first performance characteristic comprises determining the first peak pressure differential, and the determining PERF2 the second performance characteristic comprises determining the second peak pressure differential. The one or more predetermined criteria being met then comprises a difference, or ratio, between the first peak pressure differential and the second peak pressure differential meeting, or being below, a difference threshold. In some examples, though not shown in FIG. 3, the determining STATE the state (e.g., loss) of charge comprises determining the difference, or ratio, between the first and second peak pressure differentials, and/or comparing the difference, or ratio, to the difference threshold. In a similar way, where first and second peak condenser-side pressure are used, the first peak condenser-side pressure may be higher than the second peak condenser-side pressure when the refrigeration system is nominally charged. When there has been a loss of charge, and/or when the refrigeration system is undercharged, there may be little to no difference the first and second peak condenser-side pressures. As such, the method may, in some examples, comprise determining and/or comparing the first and second peak condenser-side pressures. The method may also comprise determining a difference, or ratio, between the first and second peak condenser-side pressures, and/or comparing this difference, or ratio, to the difference threshold.

In some examples, the presence of the liquid receiver 150 of the refrigeration system 100 shown in FIG. 1, and/or its size, influences the magnitude of the difference between the first and second peak pressure differentials when the refrigeration system is sufficiently or nominally charged. For example, a larger liquid receiver 150 may act as more of a buffer for the gaseous refrigerant moved to the condenser side 101 during the transfer phase, leading to a lower overall increase in pressure, regardless of an operating speed of the compressor 120. Alternatively, a smaller liquid receiver 150 may provide less of a buffering effect, and may result in a greater increase in pressure when the compressor 120 is operated at a higher speed. As such, in some examples, reducing a size of the liquid receiver 150 may improve an accuracy and/or reliability of the method 300 of determining a state, such as a loss, of charge in the refrigeration system 100. In some examples, a volumetric capacity of the liquid receiver is greater than 6 litres, up to 6 litres, up to 3 litres, up to 2 litres, such as 1.8 litres, or up to 1.5 litres. In other examples, there may be no liquid receiver 150. However, it is preferable to provide a liquid receiver 150 of sufficient volumetric capacity to ensure that the refrigerant supplied to the expansion valve 140 and/or the economiser expansion valve 170 is in a predominantly liquid phase, as described above.

Although not shown in the Figures, in some examples, the refrigeration system 100 may be overcharged, such as to a level that is higher than the nominal level of charge. In other examples, there may be a gain in charge of refrigerant in the refrigeration system 100, such as during a topping up of refrigerant in the refrigeration system 100 during maintenance, and/or following a loss of charge. As the level of charge of refrigerant in the refrigeration system 100 is increased, the difference, or ratio, between the first and second peak pressure differentials may also increase. Similarly, as the level of charge of refrigerant in the refrigeration system 100 is increased, the difference, or ratio, between the first and second peak condenser-side pressures, where used, may also increase.

Figure 4C:
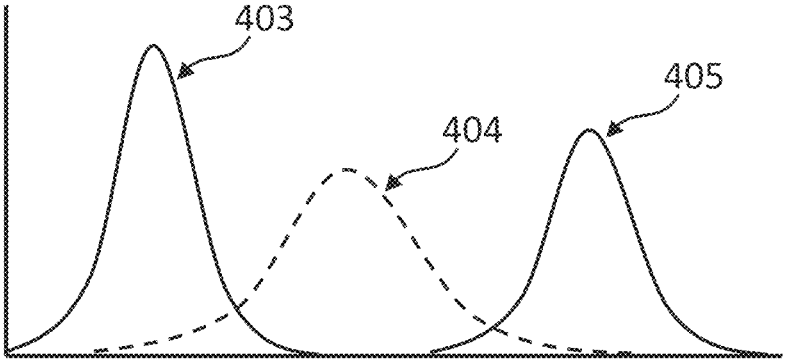
FIG. 4*c* shows a distribution of ratios of pressure differentials at different states of charge of the refrigeration system of FIGS. 1 and 2, according to an example.

FIG. 4*c* shows the distribution of ratios between the first and second peak pressure differentials at different states of charge of refrigerant. In particular, a ratio between the first and second peak pressure differentials (herein the "peak pressure ratio") is shown along the x-axis, and the number of times the peak pressure ratio is observed is shown on the y-axis. It will be appreciated that, in other examples, the peak pressure ratio may instead be a mathematical difference between the first and second peak pressure differentials, or any other suitable comparison of the first and second peak pressure differentials. The dashed curve, labelled 404, shows the distribution in the peak pressure ratio when the refrigeration system is nominally charged. The solid curve labelled 403, to the left of the dashed curve 404, shows the distribution in the peak pressure ratio when the refrigeration system 100 is undercharged, and/or when there has been a loss of charge. This indicates that, when the refrigeration system 100 is undercharged, and/or when there has been a reduction in the level of charge, the peak pressure ratio is likely to be lower than when the refrigeration system 100 is nominally charged. The solid curve labelled 405, to the right of the dashed curve 404, shows the distribution in the peak pressure ratio when the refrigeration system 100 is overcharged (and/or when there has been a gain in charge). This indicates that, when the refrigeration system 100 is overcharged, and/or when there has been an increase in the level of charge, the peak pressure ratio is likely to be higher than when the refrigeration system 100 is nominally charged. In some examples, a peak condenser-side pressure ratio, being a ratio, or mathematical difference, between the first and second peak compressor-side pressures, may be used. In such a case, the peak condenser-side pressure ratio may behave in a similar way to the peak pressure ratio shown and described with reference to FIG. 4*c*.

Figure 3B:
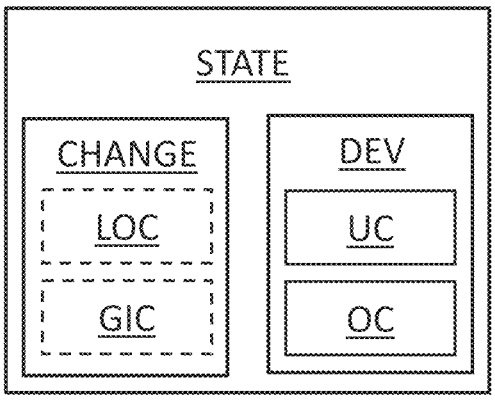
FIG. 3*b* shows a further example of the method of determining the state of charge of FIG. 3*a;*

As such, more broadly, and with reference to FIG. 3*b*, the determining STATE the state of charge of refrigerant in the refrigeration system 100 in some examples comprises determining CHANGE a change in a level of charge of refrigerant in the refrigeration system 100. This may comprise determining LOC a loss of charge in the refrigeration system 100, or determining GIC a gain in charge in the refrigeration system 100. In some examples, the determining STATE the state of charge of refrigerant comprises determining DEV a deviation in a level of charge of refrigerant from the nominal level of charge. That is, the method may comprise determining DEV that the level of charge of refrigerant falls outside of the nominal charge range. This may comprise determining UC an undercharge of refrigerant in the refrigeration system 100, such as a level of charge of refrigerant that is less than the nominal level of charge, or that is less than a lower bound of the nominal level of charge range. This may also, or alternatively, comprise determining OC an overcharge of refrigerant in the refrigeration system 100, such as a level of charge of refrigerant that is greater than the nominal level of charge, or that is greater than an upper bound of the nominal level of charge range.

Figure 5:
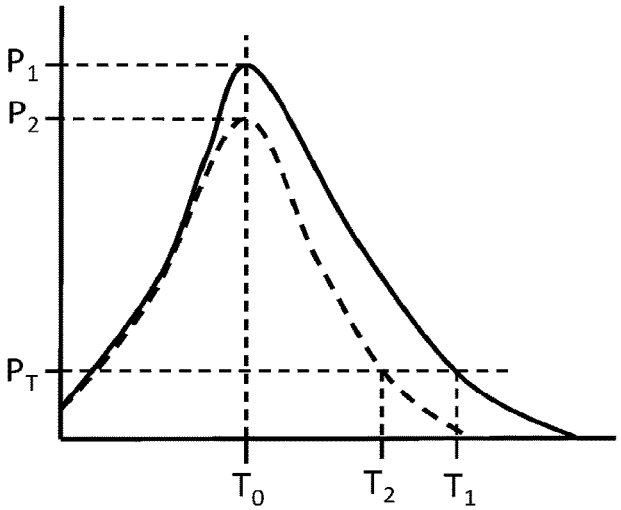
FIG. 5 shows a chart of pressures during an operation of the refrigeration system shown in FIGS. 1 and 2, according to an example.

Turning now to FIG. 5, shown is another example variation in the differential pressure during the first pump down event (solid line) and during the second pump down event (dashed line). Here, the compressor 120 is operated at the same speed during the first and second pump down events. In this example, the refrigeration system has a lower charge of refrigerant during the second pump down event than the first pump down event, such as due to a loss of charge occurring between the first and second pump down events. It will be appreciated that, here, the refrigeration system 100 may have been operated in a "normal" mode, such as to provide cooling to the space 12, between the first and second pump down events, and the loss of charge may have occurred during the normal mode. In other examples, the first and second pump down events in FIG. 5 are any other suitable pump down events where there has been a loss charge of refrigerant in the refrigeration system 100 between the pump down events.

The compressor 120 is operated for the same amount of time in each of the first and second transfer stages, and the curves are aligned so that first and second peak pressure differentials P1, P2 are temporally aligned. That is, although the first and second pump down events are performed at different times, it is assumed for the purposes of the present discussion that the peak pressure differential in each case is achieved at a zeroth time T0. A first decay time for the first pressure differential to reduce from a first elevated pressure differential, which here is the first peak pressure differential P1 to a reduced pressure differential, PT, is then compared to a second decay time for the second pressure differential P2 to reduce from a second elevated pressure differential, which here is the second peak pressure differential P2, to the reduced pressure differential PT. In other examples, the first and second elevated pressure differentials are the same as each other, and/or are each below the respective first and/or second peak pressure differentials P1, P2.

It can be seen that, where there has been a loss of charge, the pressure differential meets the reduced pressure differential PT at a first time T1, and the second pressure differential meets the reduced pressure differential PT at a second time T2, which is less than T1. That is, the second decay time is shorter than the first decay time. This may be because less refrigerant is present in the condenser side 101 during the second maintenance phase following a loss of charge, which may lead to a quicker dissipation of heat from the refrigerant, and a quicker reduction in the pressure differential. As such, in some examples, though not shown in FIG. 3, the determining STATE the state (e.g., loss) of charge comprises determining the first and second decay times, and comparing, such as determining a difference between, or determining a ratio between, the first and second decay times. If the difference, or ratio, between the first and second decay times meets, or exceeds, a decay time difference threshold, then a loss of charge of refrigerant may be determined. To the contrary, if there is a gain in charge in the refrigeration system 100 between the first and second pump down events, then T2 may be greater than T1. In such a case, if the difference, or ratio, between the first and second decay times meets, or exceeds, the decay time difference threshold, then a gain in charge of refrigerant may be determined. It will be appreciated that a similar change in the decay time may be observed when the condenser-side pressure differential is used. In such cases, the method may comprise determining first and second condenser-side pressure decay times, and comparing, such as by determining a difference between, or determining a ratio between, the first and second condenser-side pressure decay times.

In other examples, the method 300 may comprise performing only one of the first and second pump down events, such as the first pump down event, and the determining STATE the state (e.g., loss) of charge may comprise comparing the first decay time to a decay time of a previous pump down event, and/or to a decay time threshold, which in some examples is a predetermined decay time threshold. The predetermined decay time threshold, where provided, may be determined based on decay times of previous pump down events, and/or may be based on an expected decay time of a refrigeration system that is nominally charged, or considered "sufficiently charged", as described above. As such, in some examples, an undercharge of refrigerant may be determined when the decay time is less than the decay time threshold. In some examples, if the refrigeration system is overcharged, and/or if there is a gain in charge between the first and second pump down events, the decay time may be greater than the decay time threshold. In some examples, the decay time threshold may comprise an upper decay time threshold, above which the refrigeration system is deemed to be overcharged. In some examples, the decay time threshold may comprise a lower decay time threshold, below which the refrigeration system is deemed to be undercharged. In a similar way, the first condenser-side pressure decay time, where determined, may be compared to the decay time threshold, the upper decay time threshold, and/or the lower decay time threshold.

In some examples, though not shown in FIG. 3, the method 300 comprises causing performance of further equalisation, initialisation and/or pump down events following the second pump down event, and/or preceding the first pump down event. In some examples, the further pump down events are performed by operating the compressor 120 at different speeds to the first and second pump down events, particularly where a state, such as a loss, of charge is to be determined based on a difference, or ratio, between peak pressure differentials as in FIGS. 4*a* and 4*b*. Alternatively, the compressor 120 may be operated at the same speed(s) in the further pump down events, as in the first and/or second pump down events, where performed.

In further examples, though not shown in FIG. 3, the method 300 comprises determining that a state (e.g., loss) of charge in the refrigeration system exceeds a charge threshold. Specifically, this is by the method 300 comprising determining a quantity of refrigerant that has been lost from and/or gained in the refrigeration system, and comparing the quantity to the charge threshold. In some examples, the method 300 comprises taking remedial action when a loss and/or a gain of charge exceeds the charge threshold. In some examples, the charge threshold is a predetermined amount of refrigerant that can be lost from the refrigeration system, which may be an amount of refrigerant that could be lost while maintaining a level of performance of the refrigeration system within an allowable performance range. In other examples, the charge threshold is an amount of refrigerant that could be lost without posing a safety risk, such as a fire hazard. For instance, the refrigeration system could be a refrigeration system for a transport unit comprising a space for storing cargo, and the charge threshold may be an amount of refrigerant that can safely be allowed to accumulate in the space. Similar remedial action may be performed in the event of a determination that the refrigeration system 100 is overcharged and/or undercharged. For example, the remedial action could involve increasing or decreasing a level of charge of refrigerant in the refrigeration system 100, such as by charging or discharging refrigerant from the refrigeration system. Such remedial action may be performed by maintenance personnel.

It will be appreciated that in various examples the method 300, or parts thereof, are performed during a heating mode of the refrigeration system 100, such as to defrost any ice which may have built up on an external surface of the evaporator 110, and/or where there is no cooling demand from the refrigeration system 100, such as when a set point temperature in the space 12 has been reached and the compressor 120 is due to stop operating for a period of time. In other examples, the heating mode may be to heat the gas to be supplied to the space 12, such as to heat the cargo 15. In any case, in the heating mode, the refrigerant is not expanded through the expansion valve 140, and so no cooling effect is provided from the evaporator 110. In some such examples, during the equalisation stage, the bypass valve 180 is opened for a period of time to allow heat to be transferred from the refrigerant to the external gas passed over the evaporator 110, in use.

Figure 6:
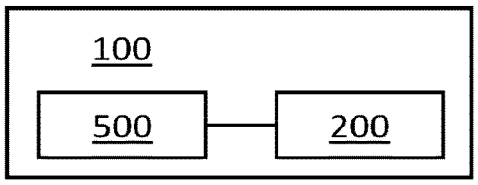
FIG. 6 shows a schematic diagram of the refrigeration system 100 of FIGS. 1 and 2 comprising a controller.

Turning now to FIG. 6, shown is a schematic diagram of the refrigeration system 100 comprising a controller 500 and the sensor system 200. In the present example, the controller 500 is a part of the refrigeration system 100, and is configured to control an operation of the refrigeration system 100. In other examples, another controller is configured to control the operation of the refrigeration system 100. In either case, the controller 500 is configured to perform the method 300 described above with reference to FIGS. 3*a* and 3*b* to determine a state (e.g., loss) of charge in the refrigeration system 100, such as by using signals received from the sensor system 200. In other examples, the controller is comprised in the transport unit 10 and/or the atmosphere control system 20. In other examples, the controller 500 is a remote controller, such as comprised in a marine vessel, or in a cloud-based computing system, and is communicatively coupled, or couplable, to the refrigeration system 100, such as to a separate controller thereof, and/or to the sensor system 200. In some such examples, the controller 500 is configured to determine a state (e.g., loss) of charge in one or more different refrigeration systems 100.

Figure 7:
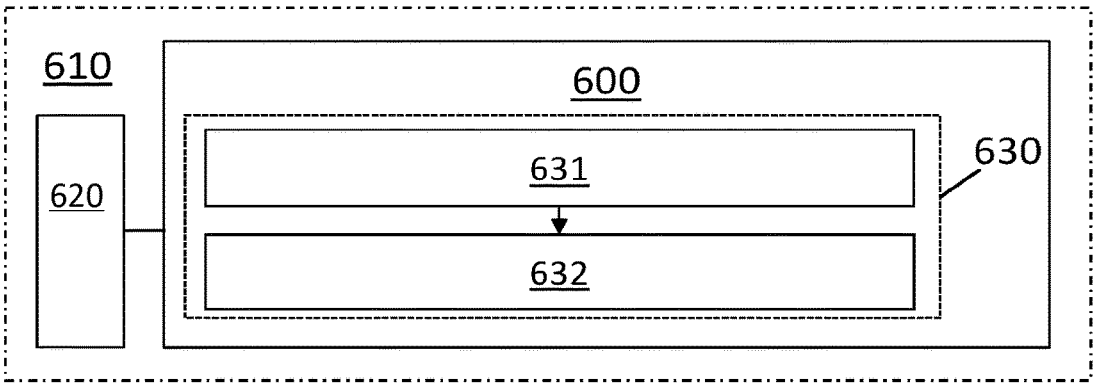
FIG. 7 shows a schematic diagram of a non-transitory computer-readable storage medium according to an example.

FIG. 7 shows a schematic diagram of a non-transitory computer-readable storage medium 600 according to an example. The non-transitory computer-readable storage medium 600 stores instructions 630 that, if executed by a processor 620 of a controller 610, cause the processor 620 to perform a method according to an example. In some examples, the controller 610 is the controller 500 as described above with reference to FIG. 6 or any variation thereof discussed herein. The instructions 630 comprise: determining 631 at least one performance characteristic of the refrigeration system 100 when refrigerant is prevented from flowing into the evaporator side 102 from the condenser side 101; and, when one or more predetermined criteria are met on the basis of the performance characteristic, determining 632 a state (e.g., loss) of charge in the refrigeration system 100. In other examples, the instructions 630 comprise instructions to perform any other example method described herein, such as the method 300 described above with reference to FIGS. 3*a* and 3*b*. In some examples, the refrigeration system 100 and/or the atmosphere control system 20, and/or the storage unit 10 comprises the non-transitory computer-readable storage medium 600.

Figure 8:
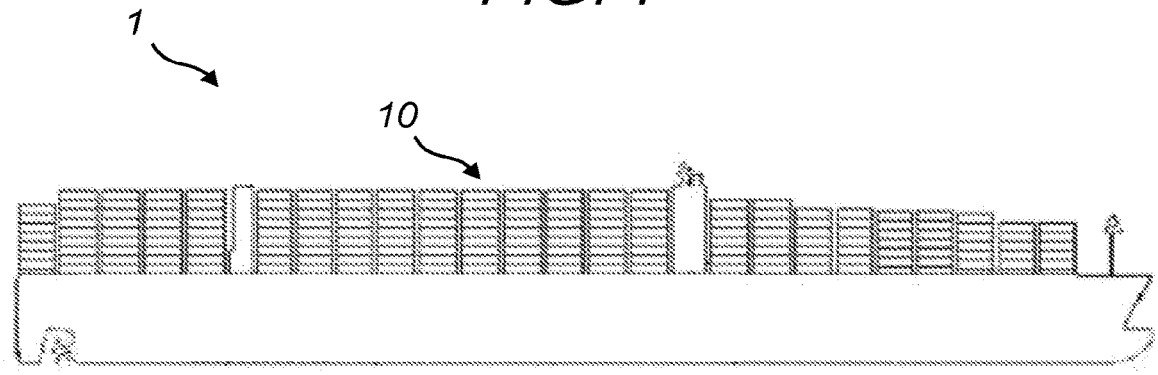
FIG. 8 shows an example marine vessel comprising the storage unit of FIG. 1.

FIG. 8 shows an example marine vessel 1, which here is a container ship. The marine vessel 10 comprises, and is configured to transport, the storage unit 10. In other examples, the marine vessel 10 comprises the controller 500, the non-transitory computer-readable storage medium 600, and/or the refrigeration system 100.

Example embodiments of the present invention have been discussed, with particular reference to the examples illustrated. However, it will be appreciated that variations and modifications may be made without departing from the scope of the invention as defined by the appended claims.

What is claimed is:

1. A method of determining a state of charge of refrigerant in a refrigeration system, the refrigeration system comprising a compressor, an expansion valve, a condenser side for passing refrigerant from the compressor to the expansion valve, and an evaporator side for passing refrigerant from the expansion valve to the compressor, the method comprising:

causing performance of a pump down event, the pump down event comprising a transfer stage in which refrigerant is prevented from flowing into the evaporator side from the condenser side, and refrigerant in the evaporator side is moved from the evaporator side to the condenser side, so that the refrigeration system reaches a pumped-down state;

determining at least one performance characteristic of the refrigeration system when refrigerant is prevented from flowing into the evaporator side from the condenser side, the at least one performance characteristic comprising a pressure differential between the condenser side and the evaporator side, and the determining comprises determining the at least one performance characteristic during the pump down event or during the pumped-down state; and when one or more predetermined criteria are met on the basis of the performance characteristic, determining a state of charge in the refrigeration system.

2. The method of claim 1, wherein the determining the state of charge comprises determining a deviation in a level of charge from a nominal level of charge in the refrigeration system.

3. The method of claim 1, wherein the determining the state of charge comprises, when the one or more predetermined criteria are met on the basis of the performance characteristic, determining a change in the level of charge in the refrigeration system.

4. The method of claim 3, wherein the change in the level of charge is a loss of charge.

5. The method of claim 1, wherein the one or more predetermined criteria being met comprises the at least one performance characteristic meeting, exceeding, or being below a predetermined threshold performance characteristic.

6. The method of claim 1, wherein the, or each, performance characteristic comprises a pressure in the condenser side and/or a pressure in the evaporator side.

7. The method of claim 1, wherein the refrigeration system comprises a condenser in the condenser side, and a condenser fan configured to move an external condenser fluid, external to the refrigeration system, past, across, or through the condenser, and wherein the method comprises causing operation of the condenser fan during the pump down event.

8. The method of claim 1, wherein the pump down event comprises, following the transfer stage, a maintenance stage in which refrigerant is prevented from flowing from the condenser side to the evaporator side, and in which refrigerant is prevented from flowing from the evaporator side to the condenser side, wherein the performance characteristic comprises a decay time, the decay time being a time for a pressure differential between the condenser side and the evaporator side to reduce from an elevated pressure differential to a reduced pressure differential, lower than the elevated pressure differential, during the maintenance stage.

9. The method of claim 8, wherein the one or more predetermined criteria being met comprises the decay time meeting, or being below, a decay time threshold.

10. The method of claim 1, wherein the pump down event is a first pump down event, and the method comprises causing performance of a second pump down event, after the first pump down event, wherein the at least one performance characteristic comprises: a first performance characteristic determined during the first pump down event; and a second performance characteristic determined during the second pump down event.

11. The method of claim 10, wherein the transfer stage of the first pump down event is a first transfer stage in which the compressor is operated at a first speed to move refrigerant from the evaporator side to the condenser side, and wherein the second pump down event comprises a second transfer stage, in which the compressor is operated at a second speed to move refrigerant from the evaporator side to the condenser side, the second speed being different to the first speed.

12. The method of claim 10, wherein the first performance characteristic comprises a first peak pressure differential determined during the first pump down event, and the second performance characteristic comprises a second peak pressure differential determined during the second pump down event.

13. The method of claim 12, wherein the one or more predetermined criteria being met comprises a difference between the first peak pressure differential and the second peak pressure differential meeting, or exceeding a difference threshold.

14. A controller configured to perform operations for determining a state of charge of refrigerant in a refrigeration system, the refrigeration system comprising a compressor, an expansion valve, a condenser side for passing refrigerant from the compressor to the expansion valve, and an evaporator side for passing refrigerant from the expansion valve to the compressor, the operations comprising:

causing performance of a pump down event, the pump down event comprising a transfer stage in which refrigerant is prevented from flowing into the evaporator side from the condenser side, and refrigerant in the evaporator side is moved from the evaporator side to the condenser side, so that the refrigeration system reaches a pumped-down state;

determining at least one performance characteristic of the refrigeration system when refrigerant is prevented from flowing into the evaporator side from the condenser side, the at least one performance characteristic comprising a pressure differential between the condenser side and the evaporator side, and the determining comprises determining the at least one performance characteristic during the pump down event or during the pumped-down state; and when one or more predetermined criteria are met on the basis of the performance characteristic, determining a state of charge in the refrigeration system.

15. A non-transitory computer-readable storage medium storing instructions that, if executed by a processor, cause the processor to perform operations for determining a state of charge of refrigerant in a refrigeration system, the refrigeration system comprising a compressor, an expansion valve, a condenser side for passing refrigerant from the compressor to the expansion valve, and an evaporator side for passing refrigerant from the expansion valve to the compressor, the operations comprising:

causing performance of a pump down event, the pump down event comprising a transfer stage in which refrigerant is prevented from flowing into the evaporator side from the condenser side, and refrigerant in the evaporator side is moved from the evaporator side to the condenser side, so that the refrigeration system reaches a pumped-down state;

determining at least one performance characteristic of the refrigeration system when refrigerant is prevented from flowing into the evaporator side from the condenser side, the at least one performance characteristic comprising a pressure differential between the condenser side and the evaporator side, and the determining comprises determining the at least one performance characteristic during the pump down event or during the pumped-down state; and when one or more predetermined criteria are met on the basis of the performance characteristic, determining a state of charge in the refrigeration system.

16. A refrigeration system comprising a controller configured to perform operations for determining a state of charge of refrigerant in the refrigeration system, the refrigeration system comprising a compressor, an expansion valve, a condenser side for passing refrigerant from the compressor to the expansion valve, and an evaporator side for passing refrigerant from the expansion valve to the compressor, the operations comprising:

causing performance of a pump down event, the pump down event comprising a transfer stage in which refrigerant is prevented from flowing into the evaporator side from the condenser side, and refrigerant in the evaporator side is moved from the evaporator side to the condenser side, so that the refrigeration system reaches a pumped-down state;

determining at least one performance characteristic of the refrigeration system when refrigerant is prevented from flowing into the evaporator side from the condenser side, the at least one performance characteristic comprising a pressure differential between the condenser side and the evaporator side, and the determining comprises determining the at least one performance characteristic during the pump down event or during the pumped-down state; and when one or more predetermined criteria are met on the basis of the performance characteristic, determining a state of charge in the refrigeration system.

17. A storage unit comprising a refrigeration system and space for storing cargo, the refrigeration system being operable to condition an atmosphere in the space, the refrigeration system comprising a controller configured to perform operations for determining a state of charge of refrigerant in the refrigeration system, the refrigeration system comprising a compressor, an expansion valve, a condenser side for passing refrigerant from the compressor to the expansion valve, and an evaporator side for passing refrigerant from the expansion valve to the compressor, the operations comprising:

causing performance of a pump down event, the pump down event comprising a transfer stage in which refrigerant is prevented from flowing into the evaporator side from the condenser side, and refrigerant in the evaporator side is moved from the evaporator side to the condenser side, so that the refrigeration system reaches a pumped-down state;

determining at least one performance characteristic of the refrigeration system when refrigerant is prevented from flowing into the evaporator side from the condenser side, the at least one performance characteristic comprising a pressure differential between the condenser side and the evaporator side, and the determining comprises determining the at least one performance characteristic during the pump down event or during the pumped-down state; and when one or more predetermined criteria are met on the basis of the performance characteristic, determining a state of charge in the refrigeration system.

18. A marine vessel comprising a controller configured to perform operations for determining a state of charge of refrigerant in a refrigeration system, the refrigeration system comprising a compressor, an expansion valve, a condenser side for passing refrigerant from the compressor to the expansion valve, and an evaporator side for passing refrigerant from the expansion valve to the compressor, the operations comprising:

causing performance of a pump down event, the pump down event comprising a transfer stage in which refrigerant is prevented from flowing into the evaporator side from the condenser side, and refrigerant in the evaporator side is moved from the evaporator side to the condenser side, so that the refrigeration system reaches a pumped-down state;

determining at least one performance characteristic of the refrigeration system when refrigerant is prevented from flowing into the evaporator side from the condenser side, the at least one performance characteristic comprising a pressure differential between the condenser side and the evaporator side, and the determining comprises determining the at least one performance characteristic during the pump down event or during the pumped-down state; and when one or more predetermined criteria are met on the basis of the performance characteristic, determining a state of charge in the refrigeration system.

19. A method of determining a state of charge of refrigerant in a refrigeration system, the refrigeration system comprising a compressor, an expansion valve, a condenser side for passing refrigerant from the compressor to the expansion valve, and an evaporator side for passing refrigerant from the expansion valve to the compressor, the method comprising:

causing performance of a first pump down event, the first pump down event comprising a transfer stage in which refrigerant is prevented from flowing into the evaporator side from the condenser side, and refrigerant in the evaporator side is moved from the evaporator side to the condenser side, so that the refrigeration system reaches a pumped-down state;

causing, after the first pump down event, performance of a second pump down event;

determining at least one performance characteristic of the refrigeration system when refrigerant is prevented from flowing into the evaporator side from the condenser side, the at least one performance characteristic comprising (i) a first performance characteristic determined during the first pump down event or during the pumped-down state, and (ii) a second performance characteristic determined during the second pump down event; and when one or more predetermined criteria are met on the basis of the performance characteristic, determining a state of charge in the refrigeration system;

wherein the first performance characteristic comprises a first peak pressure differential determined during the first pump down event, and the second performance characteristic comprises a second peak pressure differential determined during the second pump down event.

20. The method of claim 19, wherein the one or more predetermined criteria being met comprises a difference between the first peak pressure differential and the second peak pressure differential meeting, or exceeding a difference threshold.

* * * * *